US006711984B2

(12) United States Patent
Tagge et al.

(10) Patent No.: US 6,711,984 B2
(45) Date of Patent: Mar. 30, 2004

(54) BI-FLUID ACTUATOR

(76) Inventors: James E. Tagge, 41 Bentrup Ct., Lenox, MA (US) 01240; Andrew P. Howansky, 31 Palmer Rd., Craryville, NY (US) 12521; James G. Koneazny, 240 Campbell Falls Rd., Southfield, MA (US) 01259

( * ) Notice: Subject to any disclaimer, the term of this patent is extended or adjusted under 35 U.S.C. 154(b) by 4 days.

(21) Appl. No.: 10/140,483

(22) Filed: May 7, 2002

(65) Prior Publication Data

US 2002/0166445 A1 Nov. 14, 2002

Related U.S. Application Data

(60) Provisional application No. 60/289,774, filed on May 9, 2001.

(51) Int. Cl.[7] ..... F15B 15/22
(52) U.S. Cl. ..... 92/9; 92/82
(58) Field of Search ..... 92/9, 143, 114, 92/82, 181 P

(56) References Cited

U.S. PATENT DOCUMENTS

| | | | | |
|---|---|---|---|---|
| 2,891,514 A | * | 6/1959 | Moeller | 91/42 |
| 2,976,845 A | | 3/1961 | Goldring | |
| 3,176,801 A | * | 4/1965 | Huff | 92/9 |
| 3,807,284 A | | 4/1974 | Alexander et al. | |
| 4,131,166 A | | 12/1978 | Schnell | |
| 4,204,347 A | | 5/1980 | Wolters | |
| 4,326,733 A | | 4/1982 | Rubalcava | |
| 4,509,409 A | * | 4/1985 | Reeves | 92/80 |
| 4,667,475 A | | 5/1987 | Wesman | |
| 4,765,225 A | * | 8/1988 | Birchard | 91/362 |
| 4,872,359 A | | 10/1989 | Schulz et al. | |
| 5,058,385 A | | 10/1991 | Everett, Jr. | |
| 5,161,449 A | * | 11/1992 | Everett, Jr. | 91/42 |
| 5,205,456 A | | 4/1993 | Ohuchi et al. | |
| 5,247,870 A | | 9/1993 | Brasca et al. | |
| 5,247,871 A | | 9/1993 | Brasca et al. | |
| 5,650,587 A | | 7/1997 | James et al. | |
| 5,687,598 A | | 11/1997 | Kirii et al. | |
| 5,735,201 A | | 4/1998 | Mirao et al. | |
| 6,004,215 A | | 12/1999 | Morath et al. | |
| 6,089,931 A | * | 7/2000 | Gorokawa | 440/61 R |
| 6,089,985 A | | 7/2000 | Morath et al. | |
| 6,129,612 A | | 10/2000 | Reynen et al. | |

FOREIGN PATENT DOCUMENTS

JP 11-158065 AB 12/2000

* cited by examiner

*Primary Examiner*—Thomas E. Lazo
(74) *Attorney, Agent, or Firm*—Malcolm J. Chisholm, Jr.

(57) ABSTRACT

The invention is a bi-fluid actuator for precise bi-directional movement and positioning of a mechanical object or load. The bi-fluid actuator includes a pneumatic fluid container defining opposed first and second pneumatic fluid chambers, and having a first mechanical object secured between the chambers; a hydraulic fluid container defining opposed first and second hydraulic fluid chambers, and having a second mechanical object secured between the first and second hydraulic chambers; a pneumatic fluid controller; and, a hydraulic fluid controller. Directing pneumatic fluid into either the first or second pneumatic chambers, while controlling flow of hydraulic fluid between the first and second hydraulic chambers, controls movement and positioning of the mechanical objects which may be secured to a load.

13 Claims, 11 Drawing Sheets

BI-FLUID ACTUATOR

CROSS REFERENCE TO RELATED APPLICATION

This Application claims the benefit of U.S. Provisional Application Serial No. 60/289,774 filed on May 9, 2001.

TECHNICAL FIELD

The present invention relates to apparatus for accurate movement and positioning of a load, and in particular relates to a bi-fluid actuator for usage in accurately moving and positioning a load appropriately for use in automated movement, assembly manufacturing, related robotics tasks, and other industries requiring precise motion control.

BACKGROUND OF THE INVENTION

Actuators are well known in automated assembly and related tasks that utilize pneumatic, mechanical or hydraulic positioning systems. For example, it is well known to utilize an actuator to move a load carriage in repetitive movements in assembly-line manufacturing. Typical actuators include rod actuators, wherein a piston within a hollow container variably moves a rod extending out of the container back and forth between desired positions, and a load or load carriage is secured to the rod. A rodless actuator includes a sliding piston within a hollow elongate container such as a cylinder, wherein the piston is secured mechanically or magnetically to a load carriage secured to a rail or support adjacent to the hollow object so that movement of the piston moves the load carriage.

Such actuators are often powered by hydraulic fluid utilizing a controller that pumps the fluid to a chamber on a first or an opposed second side of the piston, and that also permits movement of the hydraulic fluid out of the chamber into which the piston is to be moved. Such controllers also serve to detect the position of the piston, and stop movement when the piston and linked load carriage have achieved a desired position. Hydraulic actuators provide for precision of a rate of movement and positioning of the load, however they also have substantial drawbacks associated with a necessity of pumping a hydraulic fluid that is typically freeze and boiling resistant and hence is also often a hazardous waste, along with problems of the substantial cost, complexity and service requirements of pressurized hydraulic cylinders, seals, accumulators, by-pass valves, connecting lines to and from controllers, etc. Some actuators are electro-mechanically powered with electric motors, servo motors, threaded shafts, ball screws, toothed belts, etc. They also involve substantial cost in manufacture, substantial difficulties in accurate, rapid positioning of loads, and quite significant care and service requirements.

It is also known to power existing actuators with pneumatic, or compressible fluids such as air in order to minimize cost and the difficulties associated with hydraulic and electro-mechanical actuators. However, pneumatic actuators have substantial difficulties associated with characteristics of compressible fluids and chambers having variable dimensions, etc. For example, as a chamber on one side of a piston receives compressed air to move the piston away from that chamber, the piston resists movement due to stiction, wherein seals between the piston and an interior wall of the container housing the piston, such as a cylinder, tend to adhere to the cylinder wall as a function of a pressure of the incoming pressure of the compressed air. When the stiction resistance is finally overcome, the piston commences to move and it acquires an inertia of the load that tends to sustain movement of the piston at a lower force then that required to commence movement of the piston. As the piston moves within the cylinder, the dimensions of the chamber of the piston receiving the compressed air changes, so that a constant feed of the compressed air will not exert a constant force upon the piston, and compensation in the rate of delivery of the compressed air must be made if precision is required in a rate of movement of any load secured to the piston, or to a rod, or to a load carriage secured to the piston. A constant rate of movement of the piston will also be effected by variations in dynamic forces acting upon the load, such as mechanical linkages, etc., that will cause the load to change its resistance, thereby interrupting a constant rate of motion of the piston. When it is desired to stop the moving piston at a precise location, it is necessary to take into consideration a limited braking capacity of the compressible fluid within a chamber of the cylinder into which the piston is moving as the compressible fluid is compressed by the force of the moving piston. Because of the limited braking capacity of the compressible fluid, precise motion control is unobtainable under normal conditions.

Many efforts have been undertaken to provide pneumatic actuators that provide for a relatively constant rate of motion of a load carriage and that can accurately and rapidly position a load in a repetitive fashion between varying positions. One exemplary pneumatic linear actuator is sold under the trademark "PRECISIONAIRE" by the TOL-O-MATIC, Inc. company of Hamel, Minn., U.S.A. The "PRECISSIONAIRE" actuator utilizes an elongate, hollow container housing a piston linked to a load carriage, wherein the piston is also secured to a toothed belt that forms an endless loop extending between pulleys at opposed ends of the hollow container or cylinder. A complex proportional magnetic particle brake is secured to one pulley along with a rotary encoder that is in communication with a controller which cooperate to control a rate of motion of the load carriage by braking, and to control accurate positioning by the rotary encoder and controller. While such hybrid mechanical and pneumatic actuators offer some of the convenience of compressed air pneumatic actuators, they are nonetheless expensive to manufacture and service, and are essentially limited to linear actuators. In many situations, their accuracy for position location is not satisfactory for sensitive applications.

Accordingly, there is a need for an inexpensive actuator that provides the efficiency and low cost of pneumatic actuators with the precision of rates of motion and positioning provided by hydraulic actuators or servo motors for all applications from robotics to precision assembly.

SUMMARY OF THE INVENTION

The invention is a bi-fluid actuator for precise bi-directional movement and positioning of a mechanical object. The bi-fluid actuator includes a pneumatic fluid container containing a compressible, pneumatic fluid; a hydraulic fluid container containing a non-compressible, hydraulic fluid; a first mechanical object positioned between a first chamber and an opposed second chamber of the pneumatic fluid container so that the first mechanical object may be impacted and moved by the pneumatic fluid; a second mechanical object linked to the first mechanical object and positioned so that the second mechanical object may be impacted and positioned by the hydraulic fluid; a pneumatic fluid controller that selectively directs pressurized pneumatic fluid into either the first or opposed second chamber of the pneumatic fluid container; and a hydraulic fluid controller that selectively permits passage of the hydraulic fluid between the first and opposed second chambers of the hydraulic container, so that the pneumatic fluid controller selectively powers the first and linked second mechanical objects to move in either a first or opposed second direction, and the hydraulic fluid controller selectively permits movement and controls a rate of movement and position of the second and linked first mechanical object in the first or opposed second direction by selectively permitting, controlling a rate of, and then terminating passage of the hydraulic fluid between the opposed first and second chambers of the hydraulic fluid container. In essence, the hydraulic controller and hydraulic container form a closed loop hydraulic circuit that provides for flow control and accurate positioning while the pneumatic fluid powers movement of the first and second linked mechanical objects.

In an exemplary dual rod embodiment of the bi-fluid actuator, the pneumatic and hydraulic fluid containers are adjacent hollow, elongate containers, the first and second mechanical objects are pistons with rods within the hollow, elongate containers that are connected by way of the rods extending out of the containers to contact and move a load carriage typically utilized to precisely move an apparatus in automated assembly or manufacturing. By powering movement of the load carriage with a compressible or compressed, pneumatic fluid such as air, and controlling movement rate and positioning of the carriage with a non-compressible, fluid such as standard hydraulic fluid, precision of movement and positioning may be achieved by simply controlling passage of the non-compressible, hydraulic fluid at very modest pressure loads. The hydraulic fluid is selectively directed by the hydraulic fluid controller to flow through the controller between the first and second chambers of the hydraulic fluid container.

For example, if it is desired to move the load carriage away from the first chamber of the hydraulic fluid container, the chamber of the pneumatic fluid container aligned with the first chamber of the hydraulic fluid container receives compressed fluid from the pneumatic fluid controller. The hydraulic fluid controller then permits movement of the non-compressible, hydraulic fluid to pass from the second chamber into the first chamber of the hydraulic fluid container and the pneumatic fluid will then power movement of the linked first and second mechanical objects and load carriage away from the chamber having the compressed fluid, away from the first chamber of the hydraulic fluid container until a desired position of the load carriage is obtained. At that point the hydraulic fluid controller then terminates passage of the hydraulic fluid into the first chamber, thereby terminating further movement of the linked first and second mechanical objects and load carriage.

The bi-fluid actuator therefore provides for an elegant, low-powered, clean solution to precise movement of automated mechanical objects. Because the hydraulic fluid may control positioning at low pressure loads in a closed system, traditionally expensive and complicated sealing, feeding, and pressurizing of known hydraulic systems in automated actuators may be avoided. Because freely available, compressible, air fluid is utilized only for powering movement of the first mechanical object, and hence the load carriage, the known difficulties of accurate positioning of traditional pneumatic actuators is avoided. Accurate movement rates and positioning is achieved by movement of the second mechanical object by the hydraulic fluid through a cooperative integration of the hydraulic fluid controller with the pneumatic fluid controller. Additionally, because the powering source is readily available air, substantial power is available for moving high mass loads upon the load carriage without known cost and environmental risk factors associated with complex, highly pressurized hydraulic actuators.

Accordingly, it is a general object of the present invention to provide a bi-fluid actuator that overcomes deficiencies of prior actuators in accurate movement of a load.

It is a more specific object to provide a bi-fluid actuator that provides for precision of a rate of motion and of positioning of a load without pumping a non-compressible, hydraulic fluid.

It is yet another object to provide a bi-fluid actuator that may be utilized as a linear, or rotary actuator.

It is a further object to provide a bi-fluid actuator that may be produced utilizing either metal or plastic components.

It is still another object to provide a bi-fluid actuator that may be utilized as either a rodless actuator, or as a moving rod actuator.

These and other objects and advantages of this invention will become more readily apparent when the following description is read in conjunction with the accompanying drawings.

DETAILED DESCRIPTION OF THE PREFERRED EMBODIMENTS

Figure 1:
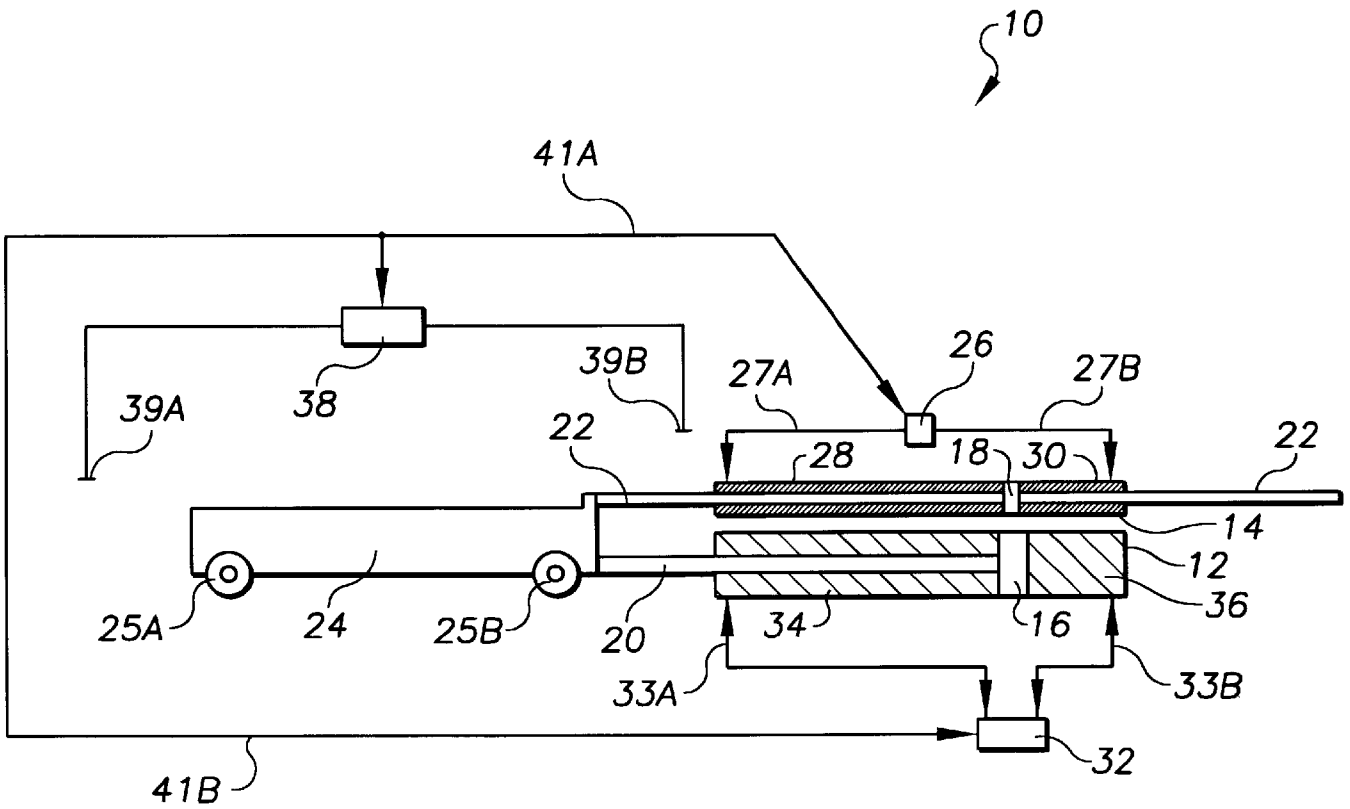
FIG. 1 is a schematic view of a bi-fluid actuator constructed in accordance with the present invention as a dual rod embodiment of the bi-fluid actuator.

In FIG. 1, a dual rod embodiment of the bi-fluid actuator is shown, and generally designated by the reference numeral 10. The dual rod embodiment 10 includes a hollow, elongate pneumatic fluid container 12 and an adjacent hollow, elongate hydraulic fluid container 14. A first mechanical object 16 is in the form of a first piston within the pneumatic fluid container 12, and a second mechanical object 18 is in the form of a second piston within the hollow hydraulic fluid container 14. A first rod 20 is connected to the first mechanical object 16, and a second rod 22 is connected to and passes through the second mechanical object 18. The two rods 20, 22 are secured to a load or load carriage 24 typically utilized to precisely move an apparatus in automated assembly or manufacturing. The load carriage 24 may have a plurality of wheels 25A, 25B or other known structures to facilitate back and forth motion. A hydraulic fluid controller 26, such as a proportional hydraulic flow control valve, is secured in fluid communication through a hydraulic lines 27A, 27B with a first hydraulic fluid chamber 28 and a second hydraulic fluid chamber 30 defined on opposed sides of the second piston 18 so that the hydraulic fluid controller 26 controls flow of a non-compressible fluid, such as hydraulic fluid, between the first and second hydraulic fluid chambers 28, 30 to thereby control movement of the second mechanical object or piston 18 and second rod 22.

A pneumatic fluid controller 32, such as a four-way pneumatic valve, is secured in fluid communication through pneumatic lines 33A, 33B between a first pneumatic fluid chamber 34 and a second pneumatic fluid chamber 36 defined on opposed sides of the first mechanical object or piston 16 so that the pneumatic fluid controller 32 may permit pressurized, compressed or compressible fluid into either the first or second pneumatic fluid chambers 34, 36, to power the first piston 16, first rod 20 and load carriage 24 secured thereto to move in a direction either toward or away from the pneumatic and hydraulic containers 12, 14.

By powering movement of the load carriage 24 with a compressible, pneumatic fluid such as air, and controlling movement rate and positioning of the carriage with a non-compressible fluid such as standard hydraulic fluid, precision of movement and positioning of the load carriage 24 may be achieved by simply controlling passage of the non-compressible, hydraulic fluid with the hydraulic fluid controller 26. The hydraulic fluid is selectively directed by the hydraulic fluid controller 26 to flow through the controller 26 between the first and second chambers 28, 30 of the hydraulic fluid container 14.

A positioning controller 38 may be secured to detect the position of the load carriage 24 between movement range limits 39A, 39B of the load carriage. The positioning controller may detect the position of the load carriage either optically, mechanically, electrically, or through any known positioning detection technology, and to communicate detected positioning information through a first position information transfer mechanism 41A to the hydraulic fluid controller 26, and through a second position information transfer mechanism 41B to the pneumatic fluid controller 32. The three controllers 38, 26, 32 may therefore function cooperatively to position the load carriage 24 in desired positions at selected times, and to move the load carriage 24 between selected positions within the movement range limits 39A, 39B at desired rates of travel. The positioning controller 38 may be any known controller capable of implementing a positioning program including detecting positions, communicating detected positions to pneumatic and/or hydraulic controllers or control valves so that the control valves may open or close in response to the communications from the positioning controller, as is well known in the art of automated actuators. The first and second position information transfer mechanisms 41A, 41B may be standard electric lines, or may be wireless transmission apparatus known in the art. The positioning controller 38 may include, or be in electrical communication with, an overall controller means for receiving information from and transmitting information to the pneumatic and/or the hydraulic controllers 26, 32 through the first and second position information transfer mechanisms 41A, 41B so that the positioning controller 38 may change, for example, to a program of detection and/or implementation of differing desired positions and/or rates of travel of the load carriage 24. The positioning controller 38 may include, for example, computers utilized for controlling positions and rates of travel of moving objects; proximity switches; linear encoders; programmable logic controllers; etc. In certain embodiments, the positioning controller 38 may communicate with only the hydraulic fluid controller 26 or only the pneumatic fluid controller 32. An exemplary positioning controller utilized in actuator technology that could be utilized with the various embodiments of the bi-fluid actuator disclosed herein is manufactured by the GALIL Motion Control Company, of Mountain View, Calif., U.S.A., and is available under the model number "DMC1415 CONTROLLER".

It is stressed that the phrase "pneumatic fluid controller" is meant to include the capacity of selectively compressing and/or directing flow of a compressed or compressible, pneumatic fluid, such as air, and may also include an ordinary air compressor as is often included in association with regular and proportional valve controllers known in the art. For purposes herein, the word "selectively" as in "a pneumatic controller" or "hydraulic controller" that "selectively directs", or "selectively permits", is meant to indicate that the controller may be controlled to stop flow; permit flow at any of varying rates of flow; or pump flow of a fluid passing through the controller. It is also to be understood that for purposes herein, the term "chamber" as used to describe voids defined on opposed sides of mechanical objects such as the above-described first and second pistons 16, 18, is meant to describe chambers or voids of varying dimensions and volumes as the mechanical objects move, and is not to be construed as voids of limited or specific dimensions or volumes.

The following embodiments of the bi-fluid actuator also include a pneumatic fluid controller, a hydraulic fluid controller, and may also include a positioning controller appropriate for a particular task of the described embodiments of the bi-fluid actuators. The pneumatic, hydraulic and positioning controllers described below also operate in essentially the same manner as described above or as known in the art, unless otherwise indicated, and therefore the operation of those components in the following embodiments will not be repeatedly described.

Figure 2:
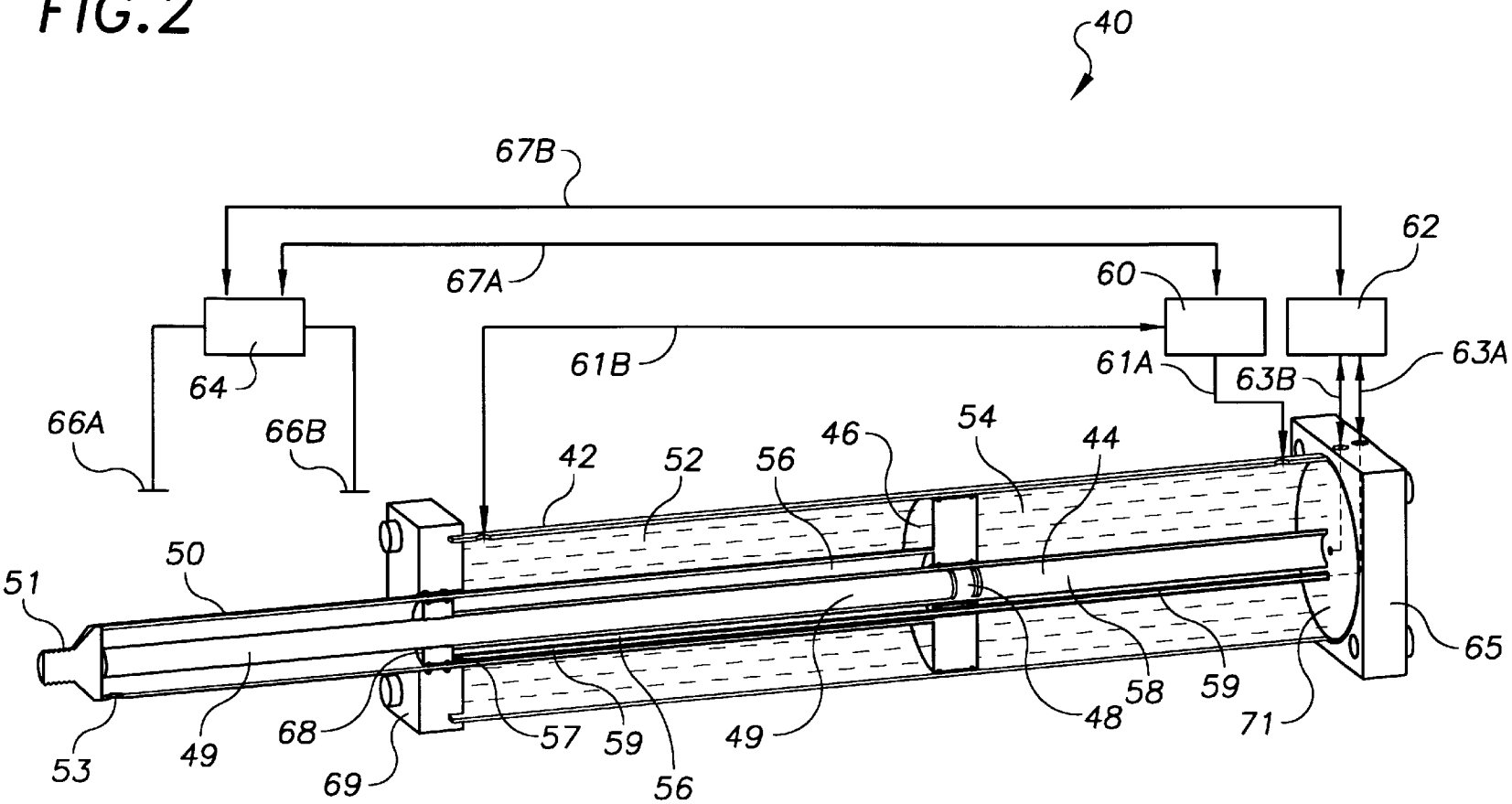
FIG. 2 is a partial fragmentary, perspective of a single rod embodiment of the bi-fluid actuator.

In FIG. 2, a single rod embodiment of the bi-fluid actuator 40 is shown, wherein a pneumatic fluid container 42 surrounds as a sleeve a coaxial hydraulic fluid container 44. A first mechanical object 46 is in the form of an "0", or doughnut-shaped piston that surrounds or partially surrounds the hydraulic fluid container 44, and a second mechanical object 48 is in the form of a piston within the hydraulic fluid container 44 that is mechanically linked to the first mechanical object 46 through a solid shaft 49 that is secured to and end cap 51, which in turn is mechanically secured to a hollow rod 50. The hollow rod 50 is secured to the first mechanical object 46 and passes out of the pneumatic fluid container 42 to be secured to and move a load carriage (not shown in FIG. 2) secured to the hollow rod 50 by way of a threaded portion of the end cap 51, or other securing apparatus.

The first mechanical object 46 is secured between a first pneumatic fluid chamber 52 and a second pneumatic fluid chamber 54 of the pneumatic fluid container 42. The second mechanical object 48 is secured between a first hydraulic fluid chamber 56 and a second hydraulic fluid chamber 58 of a hydraulic fluid container 44, which includes the hollow rod 50. A hydraulic fluid reservoir tube 59 lies adjacent and parallel to the hydraulic fluid container 44, and in fluid communication with the first hydraulic chamber 56 of the hydraulic container 44. The first mechanical object 46 may also surround the hydraulic reservoir tube 59. Hydraulic fluid passes from the second hydraulic fluid chamber 58 through a hydraulic controller 62 into the hydraulic fluid reservoir tube 59 and then through a hydraulic fluid reservoir opening 57 defined within a hydraulic end cap 68 secured to the hydraulic fluid container 44, and then into the first hydraulic chamber 56 to define a closed hydraulic loop. As the second mechanical object 48 moves along the hydraulic fluid container 44 away from the second hydraulic fluid chamber 58, (from right to left as viewed in FIG. 2), hydraulic fluid moves from the first hydraulic fluid chamber 56 through the fluid reservoir opening 57 into the hydraulic fluid reservoir tube 59, and through a header 65 that seals both the second pneumatic chamber 54 and the second hydraulic chamber 58. The hydraulic fluid reservoir tube 59 is a fluid extension of the first hydraulic chamber 56.

A pneumatic fluid controller 60 is secured in fluid communication between the first and second pneumatic chambers 52, 54 by way of standard pneumatic lines 61A, 61B, so that the pneumatic controller 60 may selectively direct and/or compress pneumatic fluid into either the first or second pneumatic fluid chambers 52, 54 of the pneumatic fluid container 42. A hydraulic fluid controller 62 is secured in fluid communication between the first and second hydraulic fluid chambers 56, 58 by way of standard hydraulic lines 63A, 63B. Hydraulic line 63A is in fluid communication between the hydraulic fluid controller 62 and the first hydraulic fluid chamber 56 through the hydraulic reservoir tube 59, and hydraulic line 63B is in fluid communication between the hydraulic fluid controller 62 and the second hydraulic fluid chamber 58. Both hydraulic lines 63A, 63B pass through the header 65 secured in a first end seal 71 of the pneumatic fluid container 42 that directs the hydraulic fluid into the hydraulic fluid reservoir tube 59 or the second hydraulic fluid chamber 58.

Figure 2A:
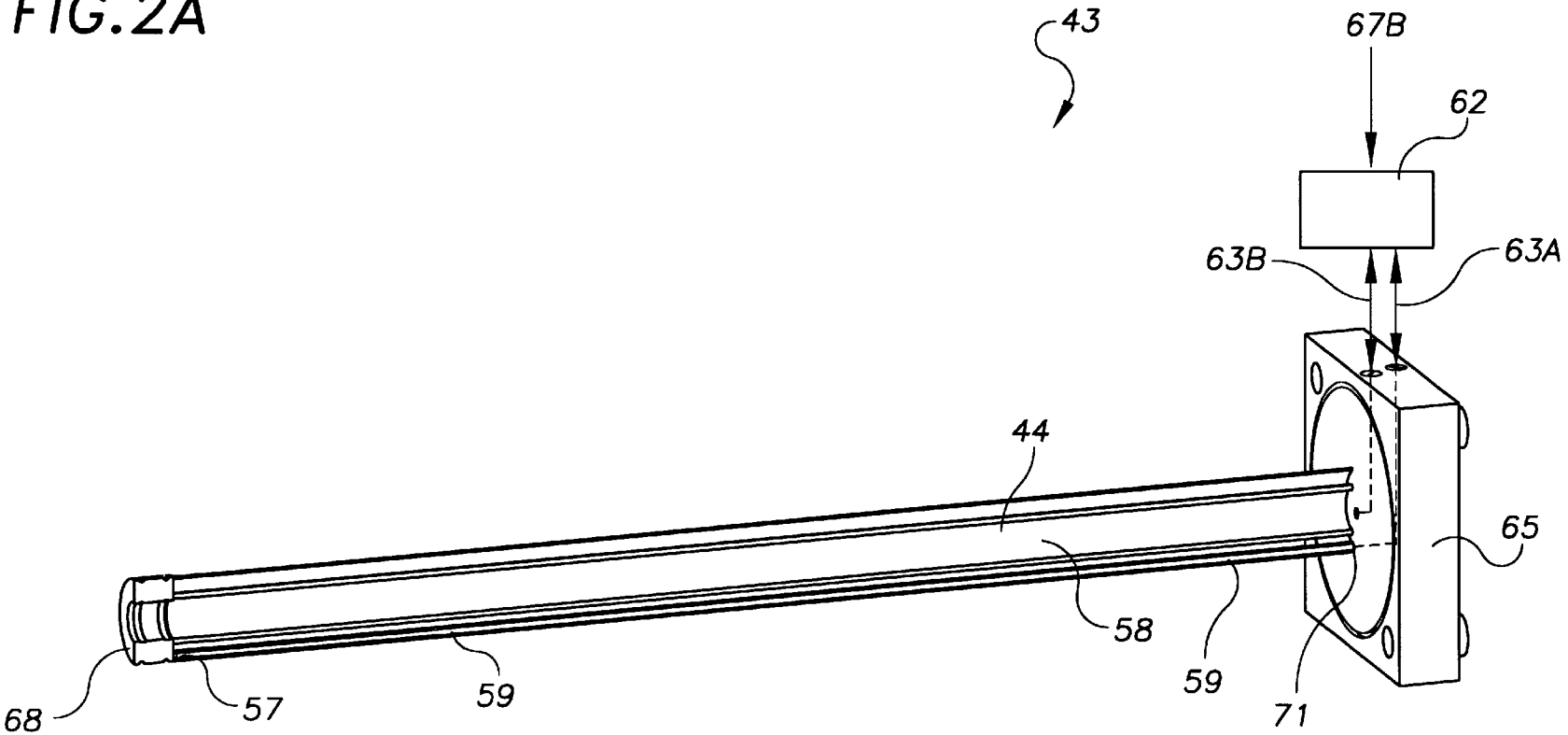
FIG. 2A is a first partial view of the FIG. 2 single rod embodiment of the bi-fluid actuator.

In FIG. 2A, a stationary hydraulic circuit 43 is shown and includes the hydraulic container 44, which is secured to the header 65 on one end, and an opposed end of the hydraulic container 44 is secured to a hydraulic end cap 68 so that the hydraulic container 44 is mechanically supporting the hydraulic end cap 68. The hydraulic fluid reservoir tube 59 is attached to the header 65 on one end and an opposed end of the hydraulic fluid reservoir tube 59 is attached to the hydraulic end cap 68 so that the hydraulic fluid reservoir tube 59 also mechanically supports the hydraulic end cap 68. The hydraulic fluid reservoir tube 59 is in fluid communication with the hydraulic fluid reservoir opening 57 defined within the end cap 68, and the opening 57 allows fluid to flow through the hydraulic fluid reservoir tube 59 and into or out of the first hydraulic fluid container 56. The header 65, the hydraulic chamber 44, the hydraulic fluid reservoir tube 59, the hydraulic fluid reservoir opening 57, and the hydraulic end cap 68 do not move relative to each other.

Figure 2B:
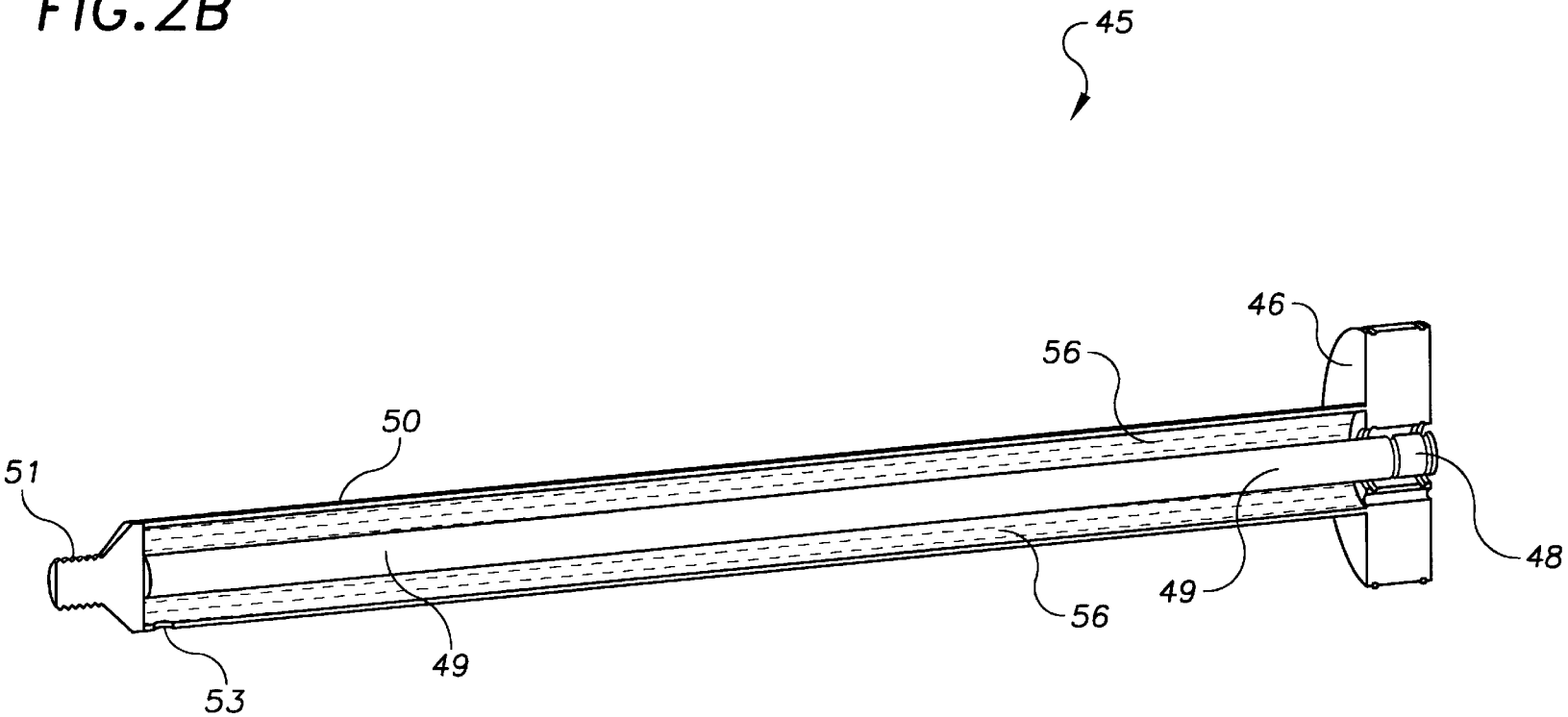
FIG. 2B is a second partial view of the FIG. 2 single rod embodiment of the bi-fluid actuator.

A moving hydro-pneumatic circuit 45 is shown in FIG. 2B, and comprises the second mechanical object 48 which is secured to the inner solid shaft 49, that is secured to the threaded adapter 51, which in turn is secured to the hollow rod 50. The hollow rod 50 is secured to the first mechanical object 46. The entire assembly of the second mechanical object 48, the inner solid shaft 49, the threaded adapter 51, the hollow rod 50, and the first mechanical object 46 all move as one circuit 45 within the compressible or pneumatic fluid container 42.

As shown in FIG. 2, the first mechanical object 46, upon being impacted by air or another compressible fluid, moves the hollow rod 50 so that the threaded adapter of the end cap 51 moves closer or further away from a second end seal 69, similar to typical air cylinders on the market. The air or other compressible fluid enters through lines 61A or 61B and creates motive force against the first mechanical object 46 to extend or retract the hollow shaft 50. The first and second hydraulic chambers 56 and 58 are defined within the hydraulic container 44, which includes the hollow rod 50, as the moving hydro-pneumatic circuit 45 is integrated with stationary hydraulic circuit 43, as shown in FIG. 2. The first hydraulic chamber 56 acts as an accumulator to accept hydraulic fluid from the hydraulic fluid reservoir opening 57 or to force hydraulic fluid back out the hydraulic fluid reservoir opening 57. The hydraulic fluid reservoir opening 57, allows hydraulic fluid to flow between the hydraulic fluid reservoir tube 59 and the first hydraulic chamber 56. The hydraulic fluid reservoir tube 59, allows hydraulic fluid to flow through line 63A into the hydraulic fluid controller 62, and then into the second hydraulic chamber 58 as the hydraulic fluid is moved in one direction or another by movement of the second mechanical object 48 which is powered by movement of the first mechanical object 46. The closed loop hydraulic circuit consisting of the moving hydro-pneumatic circuit 45 and the stationary hydraulic circuit 43 can be used to control the rate of movement and/or starting and stopping of the hollow rod 50. Due to the sealed environment inside the system it is necessary to include a relief opening 53 for air to escape from the hollow rod 50.

A positioning controller 64 may be secured to detect a position of any load carriage or apparatus (not shown) secured to the rod 50 moved by the linked first and second mechanical objects 46, 48 between range limits 66A, 66B. The positioning controller 64 may communicate detected positioning information through a first information transfer mechanism 67A to the pneumatic fluid controller 60, and through a second information transfer mechanism 67B to the hydraulic controller 62. The three controllers 60, 62, and 64 may be integrated, such as through computerized overall controller means known in the art for positioning the hollow rod 50 in desired positions at desired times, and to be moved at desired rates of speed.

Figure 3:
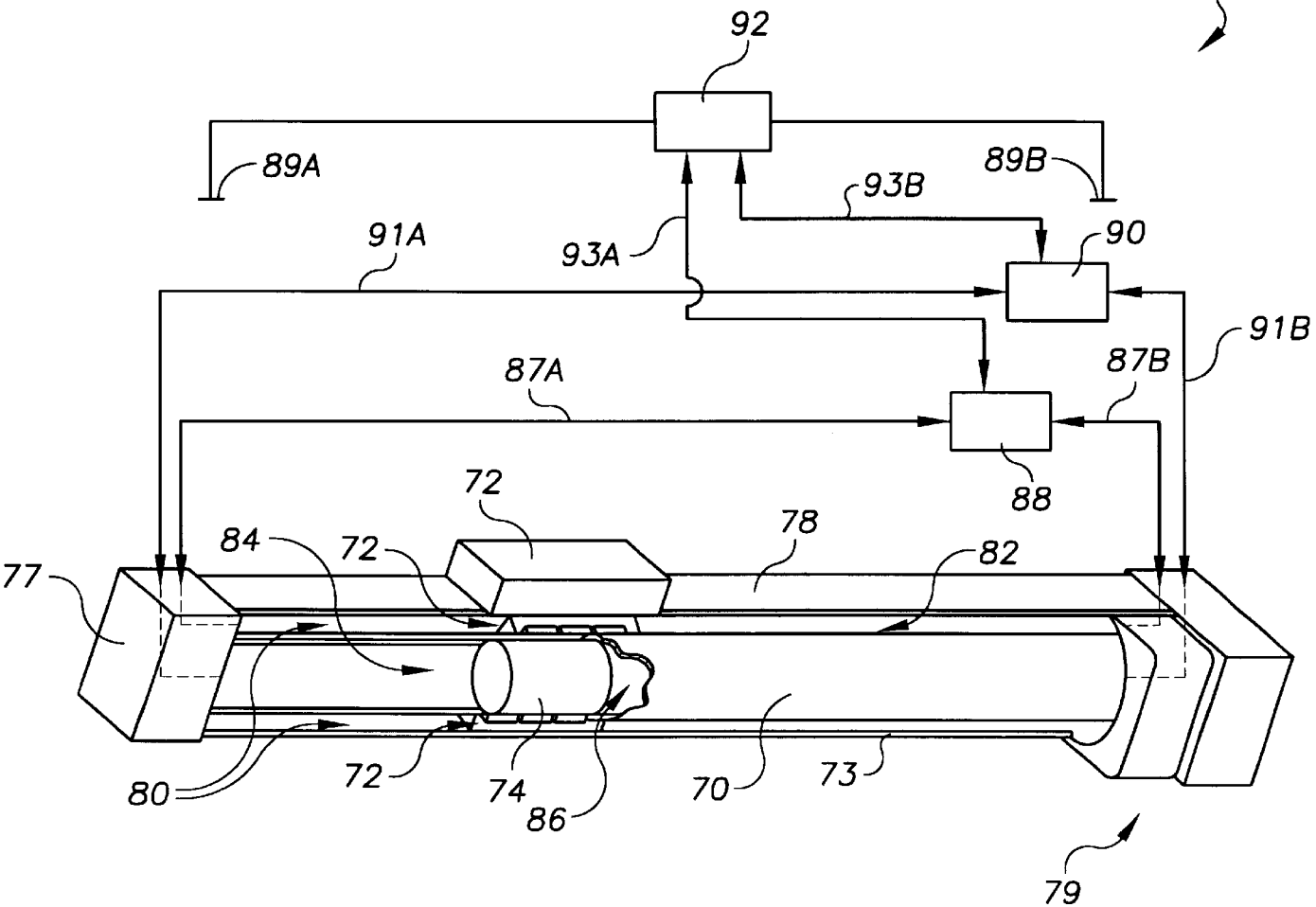
FIG. 3 is a partial fragmentary, perspective view of a rodless piston embodiment of the bi-fluid actuator.

In FIG. 3, a rodless piston embodiment of the bi-fluid actuator 66 is shown, wherein a pneumatic fluid container 73 is in the shape of a sleeve, or partial sleeve defining an "O" or "C" shaped void, and a hydraulic fluid container 70 is a hollow, elongate container positioned within and coaxial with the pneumatic fluid container 73. A first mechanical object 72 is an "O" or "C" shaped piston magnetically (as shown in FIG. 3) or mechanically linked to a second mechanical object 74 which is in the shape of a rodless or flat piston. The first mechanical object 72 is dimensioned to fit within the pneumatic fluid container 73 while making a sliding air seal within the container 73. The first mechanical object 72 may also be dimensioned to surround, or partially surround the hydraulic fluid container 70, and is also mechanically or magnetically (as shown in FIG. 3) linked to a load carriage 76 supported on a track 78 adjacent to the pneumatic fluid container 73 and extending between a first end seal 77 and a second end seal 79 of the pneumatic fluid container 73. The first mechanical object 72 is secured between a first pneumatic fluid chamber 80 and a second pneumatic fluid chamber 82. The second mechanical object 74 is secured between a first hydraulic fluid chamber 84 and a second hydraulic fluid chamber 86.

A pneumatic fluid controller 88 is secured in fluid communication through pneumatic lines 87A, 87B between the first and second pneumatic fluid chambers 80, 82. A hydraulic fluid controller 90 is secured in fluid communication through hydraulic line 91A, 91B between the first and second hydraulic fluid chambers 84, 86. As described above with reference to FIG. 2, The pneumatic controller 88 may direct compressed pneumatic fluid through pneumatic line 87A into the first pneumatic fluid chamber 80, and permits pneumatic fluid to move out of the second pneumatic fluid chamber 82 through pneumatic line 87B to be released to the atmosphere. The hydraulic controller 90 may then permit passage of hydraulic fluid from the second hydraulic fluid chamber 86, through hydraulic line 91B, through the hydraulic fluid controller 90, through hydraulic fluid line 91A, and into the first hydraulic fluid chamber 84 in order to permit movement toward the second end seal 79 of the second mechanical object 74, linked first mechanical object 72, and the load carriage 76 that is also linked to the first mechanical object 72.

A positioning controller 92 may be secured or arranged properly in order to detect a position of the load carriage 76 or other apparatus secured to the linked first and second mechanical objects 72, 74 between movement range limits 89A, 89B. The positioning controller 92 may communicate detected positioning information through a first information transfer mechanism 93A to the pneumatic fluid controller 88, and through a second information transfer mechanism 93B to the hydraulic controller 90. The positioning, pneumatic and hydraulic controllers 92, 88, 90 would work generally as described above to control position and rate of travel of the load carriage 76. The positioning controller may include, be integrated with, or be in communication with an overall controller means for communicating detected and desired positioning commands to the hydraulic and pneumatic controllers 88, 90, as described above for all embodiments of the bi-fluid actuator.

Figure 4:
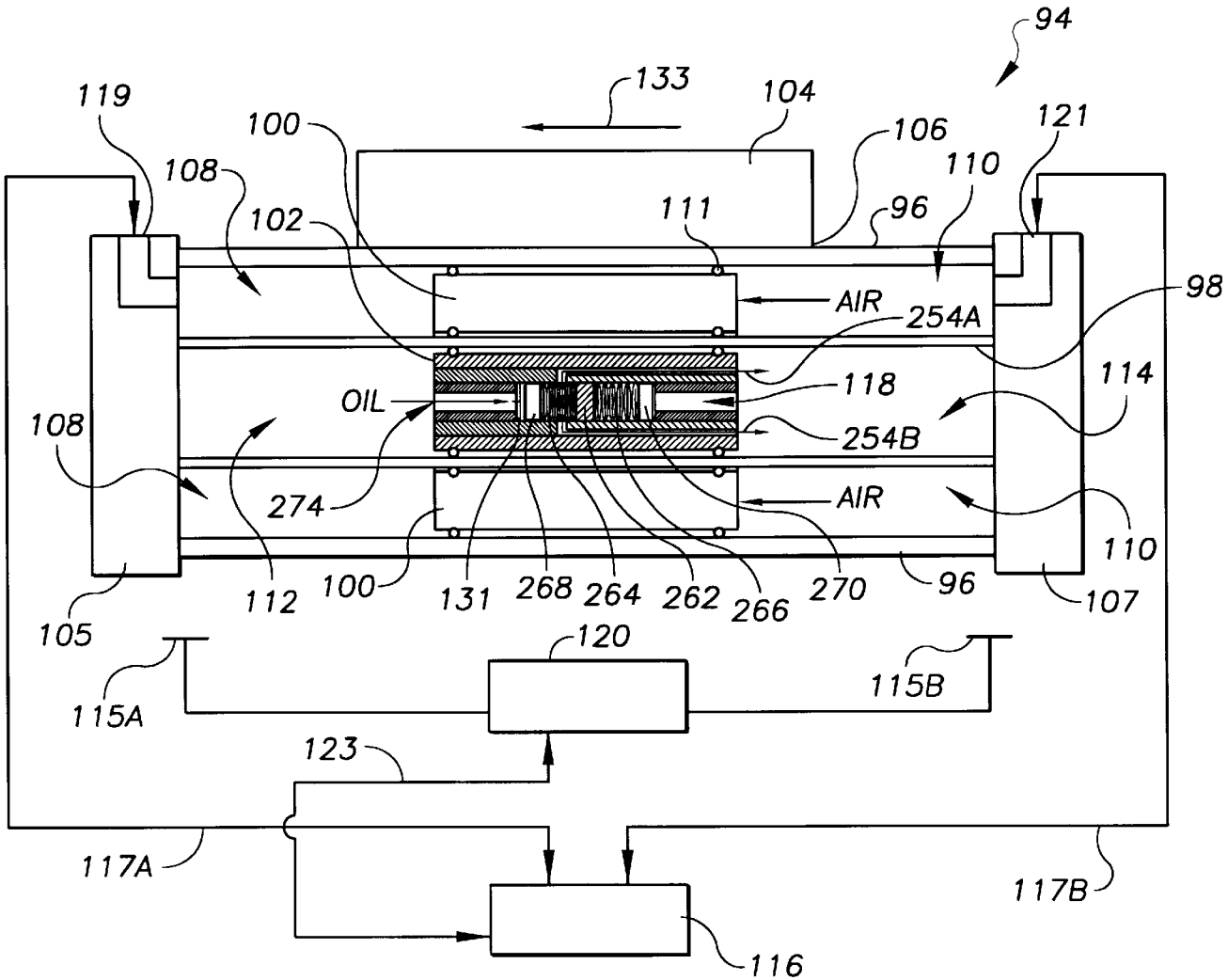
FIG. 4 is a schematic view of a rodless valved piston embodiment of the bi-fluid actuator.

In FIG. 4, a rodless valved piston embodiment of the bi-fluid actuator 94 is shown, wherein a pneumatic fluid container 96 is in the shape of a sleeve, or partial sleeve, defining an "O" of "C" shaped void, and a hydraulic fluid container 98 is a hollow elongate container positioned within and coaxial with the pneumatic fluid container 96. A first mechanical object 100 is in the shape of a "O" or "C" shaped piston magnetically (as shown in FIG. 4) or mechanically linked to a second mechanical object 102 which is in the shape of a rodless piston. The first mechanical object 100 is mechanically or magnetically linked (as shown in FIG. 4) to a load carriage 104 supported on a track 106 adjacent to or defined in the pneumatic fluid container 96. The track 106 extends between a first header 105 and a second header 107 of the pneumatic fluid container 96. The first mechanical object 100 is secured between a first pneumatic fluid chamber 108 and a second pneumatic fluid chamber 110. The second mechanical object 102 is secured between a first hydraulic fluid chamber 112 and a second hydraulic fluid chamber 114.

A pneumatic fluid controller 116 is secured in fluid communication through pneumatic lines 117A, 117B between the first pneumatic fluid chamber 108 through a first header 119 in the first header 105, and through a second header 121 in the second header 107. A hydraulic fluid controller 118 is secured in fluid communication between the first and second hydraulic fluid chambers 112, 114. A positioning controller 120 is secured to detect a position of the load carriage 104 or other apparatus secured to the linked first and second mechanical objects 100, 102 between movement range limits 115A, 115B. The positioning controller 120 may communicate detected positioning information through an information transfer mechanism 123 to the pneumatic fluid controller 116. The positioning controller 120 may be integrated with or be in communication with an overall controller means. A plurality of seals 111, such as standard "O-ring" seals, are secured between the first and second mechanical objects 100, 102 and the pneumatic and hydraulic fluid containers 96, 98, in a standard manner well known in the art to provide fluid seals while permitting sliding motion.

As shown in FIG. 4, in the rodless valved piston embodiment of the bi-fluid actuator 94, the hydraulic fluid controller 118 is in the form of a two-way, spring pre-set valve 118 secured within the second mechanical object 102, so that a specific valve-override pressure load of the pneumatic fluid directed by the pneumatic fluid controller 116 to either the first or second pneumatic fluid chambers 108, 110 will direct an adequate force through the linked first and second mechanical objects 100, 102 to override a pre-set pressure of the valve 118 to thereby open it to movement of the non-compressible, hydraulic fluid through the valve 118. That permits movement of the second mechanical object 102, linked first mechanical object 100 and load carriage 104 away from the pneumatic fluid chamber having the specific valve-override pressure load, or the powered chamber. The positioning controller 120 and the pneumatic fluid controller 116 then cooperate to decrease the compressed fluid load to the powered chamber whenever the positioning controller detects the load carriage at a desired location so that the hydraulic fluid controller or two-way, spring pre-set valve 118 closes to terminate movement of the hydraulic fluid through the valve 118, and thereby terminate movement of the second mechanical object 102, first mechanical object and linked load carriage 104.

Figure 4A:
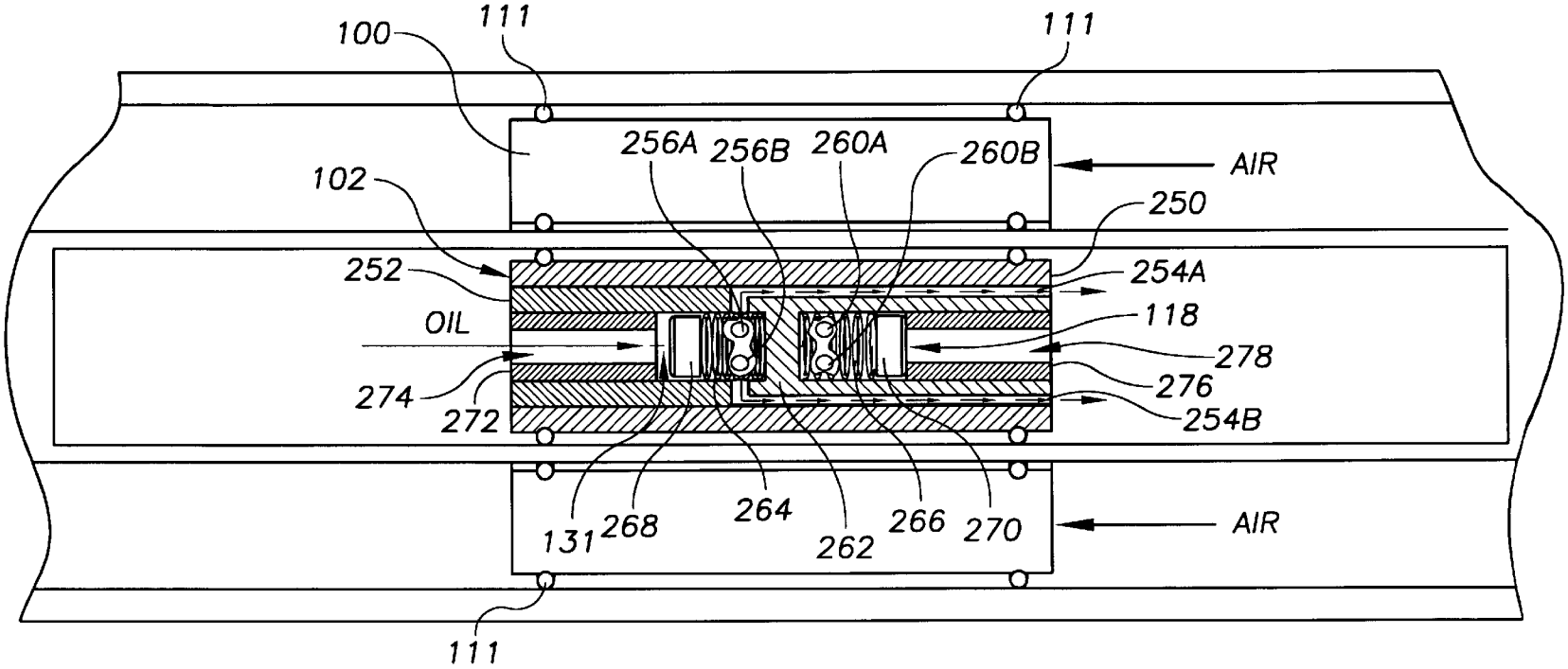
FIG. 4A is an enlarged, partial view of the FIG. 4 rodless valved piston embodiment of the bi-fluid actuator.
Figure 4B:
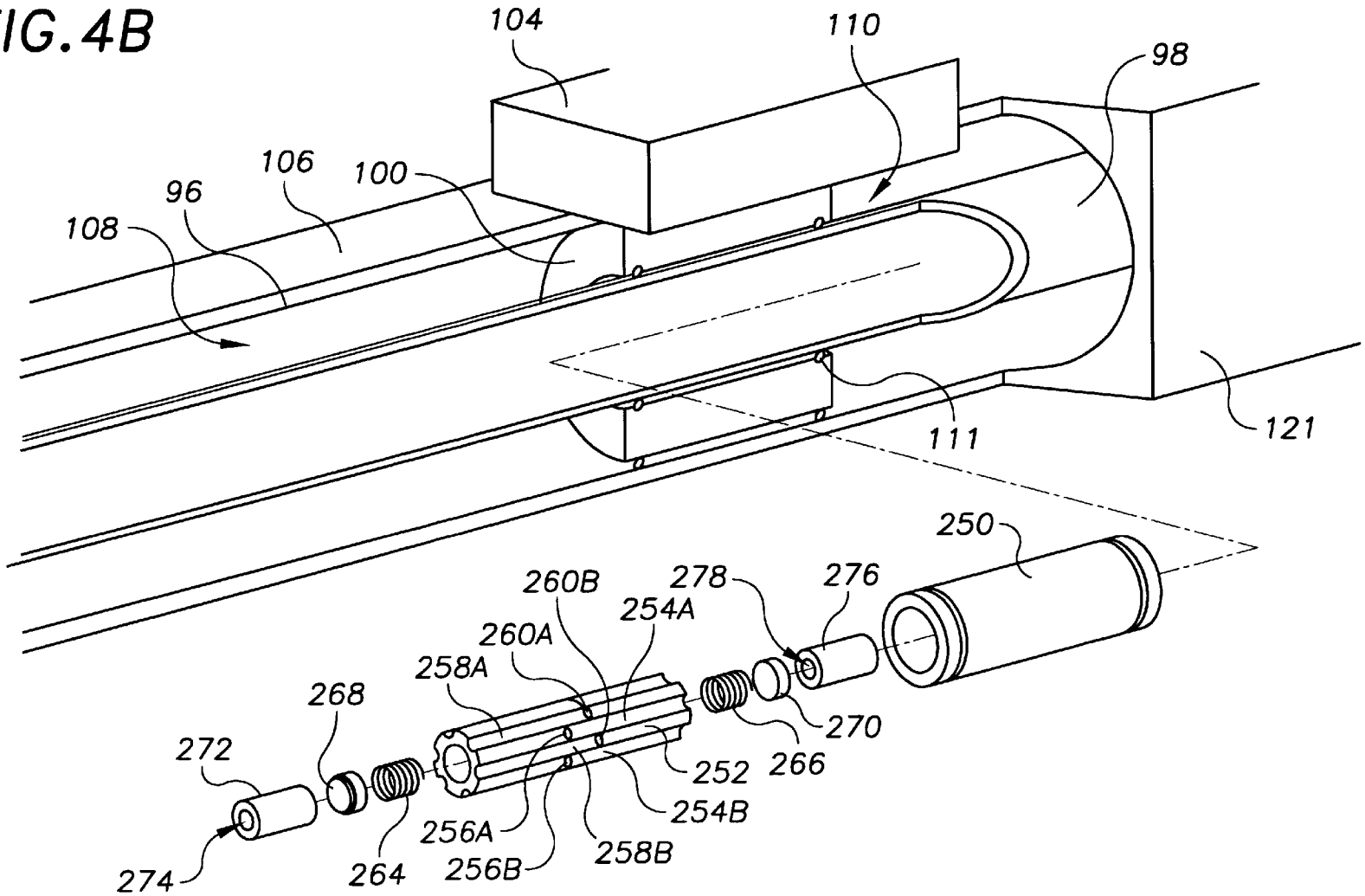
FIG. 4B is an exploded view of a second mechanical object of the FIG. 4 rodless valved piston embodiment of the bi-fluid actuator.

As best seen in FIGS. 4A and 4B, the two-way, spring pre-set valve 118 includes an outer sleeve 250 that houses a by-pass barrel 252. The by-pass barrel 252 defines at least one or a plurality of first hydraulic chamber fluid by-pass grooves 254A, 254B that are in fluid communications with a corresponding plurality of first hydraulic fluid chamber ports 256A, 256B (shown best in FIG. 4A). The by-pass barrel also defines at least one or a plurality of second hydraulic fluid chamber by-pass grooves 258A, 258B, that are in fluid communication with a corresponding plurality of second hydraulic fluid chamber by-pass ports 260A, 260B. The by-pass barrel 252 also defines a by-pass throughbore 131 having a spring wall 262 (shown only in FIGS. 4 and 4A) that may be integral with the by-pass barrel 252, or secured within the barrel 252, between the first hydraulic chamber by-pass ports 256A, 256B and the second hydraulic chamber by-pass ports 258A, 258B.

A first coiled spring 264 is secured within the by-pass throughbore 131 against a side of the spring wall 262 nearest to the first hydraulic chamber 112, and a second coiled spring 266 is secured within the by-pass throughbore 131 against a side of the spring wall 262 nearest the second hydraulic fluid chamber 114. A first moving seal 268 is secured to the first coiled spring 264, and a second moving seal 270 is secured to the second coil spring 266. A first seal lock 272 is secured within the by-pass throughbore 131 adjacent to the first moving seal 268 when the first coiled spring 264 is extended so that the when the first coiled spring 264 is compressed, a void is defined between the first seal lock 272 and the first moving seal 268. The first seal lock 272 defines a first by-pass passage 274. A second seal lock 276 is secured within the by-pass throughbore 131 adjacent to the second moving seal 270 when the second coiled spring 266 is extended so that the when the second coiled spring 266 is compressed, a void is defined between the second seal lock 276 and the second moving seal 270. The second seal lock defines a second by-passage 278.

The diameters of the first and second moving seals 268, 270 are cooperatively dimensioned to be larger than corresponding diameters of the first and second by-pass passages 274, 278 so that whenever the first or second coiled springs 264, 266 force the first or second moving seals 268, 270 into contact with adjacent first or second seal locks 272, 276, the moving seals 268, 270 completely block the first or second by-pass passage 274, 278 thereby restricting movement of the hydraulic fluid through the blocked first or second by-pass passage 274, 278. Such blocking may be facilitated by having chamfered ends of the first and second moving seals 268, 270, or by other known sealing means known in the art, such as compressible "O-ring" seals (not shown), etc. Shortest diameters of the first and second moving seals 268, 270 are also cooperatively dimensioned to be less than diameters of the by-pass throughbore 131, so that whenever the first or second moving seal 268, 270 are displaced out of contact with the first or second seal lock 272, 276, hydraulic fluid may flow around the first or second moving seal 268, 270, and then into either the plurality of first or second hydraulic fluid chamber by-pass ports 256A, 256B, 260A, 260B and their corresponding plurality of first or second hydraulic fluid chamber grooves 254A, 254B, 258A, 258B.

In use of the two-way, spring pre-set valve 118, the first and second coil springs 264, 266 are selected to have a specific compressive force or valve-override pressure load that must be achieved to compress the springs 264, 266. If it is desired to move the load carriage in a specific direction to a specific location, such in the direction of the arrow 133 in FIG. 4, the pneumatic controller, which may be an overall controller means as described above, or may be a pneumatic proportional valve integrated with a four-way solenoid valve, directs an adequate air pressure into the second pneumatic chamber 110 to overcome the valve-override pressure load of the first coil spring 264. The first coil spring 264 and first moving seal 268 then move out of contact with the first seal lock 272 (as shown best in FIG. 4A) so that hydraulic fluid may move from the first hydraulic fluid chamber 1112 through the by-pass throughbore 131 into the second hydraulic fluid chamber 114, thereby permitting motion of the second mechanical object 102, the first mechanical object 100 and load carriage.

Whenever it is desired to stop movement of the load carriage, such as when the positioning controller 120 detects the load carriage at a desired location, then the pneumatic controller 120 or any other known controller means directs the pneumatic controller to decrease the pressure of the compressible fluid within the second pneumatic chamber 110 to below the specific valve-override pressure load of the first coil spring 264. The spring 264 then moves the first moving seal 268 back into contact with the first seal lock 272 so that the hydraulic fluid can no longer move through the by-pass throughbore, or actually, so that the second mechanical object 102 can no longer move through the hydraulic fluid within the hydraulic container 98, thereby terminating movement of the second mechanical object 102.

The two-way, spring pre-set valve 118 may be in the above-described form, or may be any two-way, spring pre-set valve means for permitting and terminating two-way flow of a non-compressible fluid through the valve in response to pressure changes acting upon the valve that are known in the art. Additionally, the two-way, spring pre-set valve 118 may be situated in fluid communication with the second mechanical object 102 through standard hydraulic lines, but external to the pneumatic and hydraulic containers 96, 98.

The pneumatic controller 116 must include a proportional pressure valve (not shown) in fluid communication with a four-way solenoid valve (not shown), that is in fluid communication with the pneumatic lines 117A, 117B. The positioning controller 120 would be in communication with the proportional pressure valve and/or the four-way solenoid valve. The pneumatic controller may also include an air pressure monitoring device (not shown) that is constantly sending pressure readings within the powered pneumatic chamber (such as the second pneumatic chamber 110 in the above example of operation) to the pneumatic controller, or an overall controller integrated with or in communication with the pneumatic controller 116. Additionally, the pneumatic controller may include a precision regulator known in the art that is able to change precise pressure levels very quickly for enhanced efficiency of operation of the rodless valved piston embodiment 94 of the bi-fluid actuator.

Figure 5:
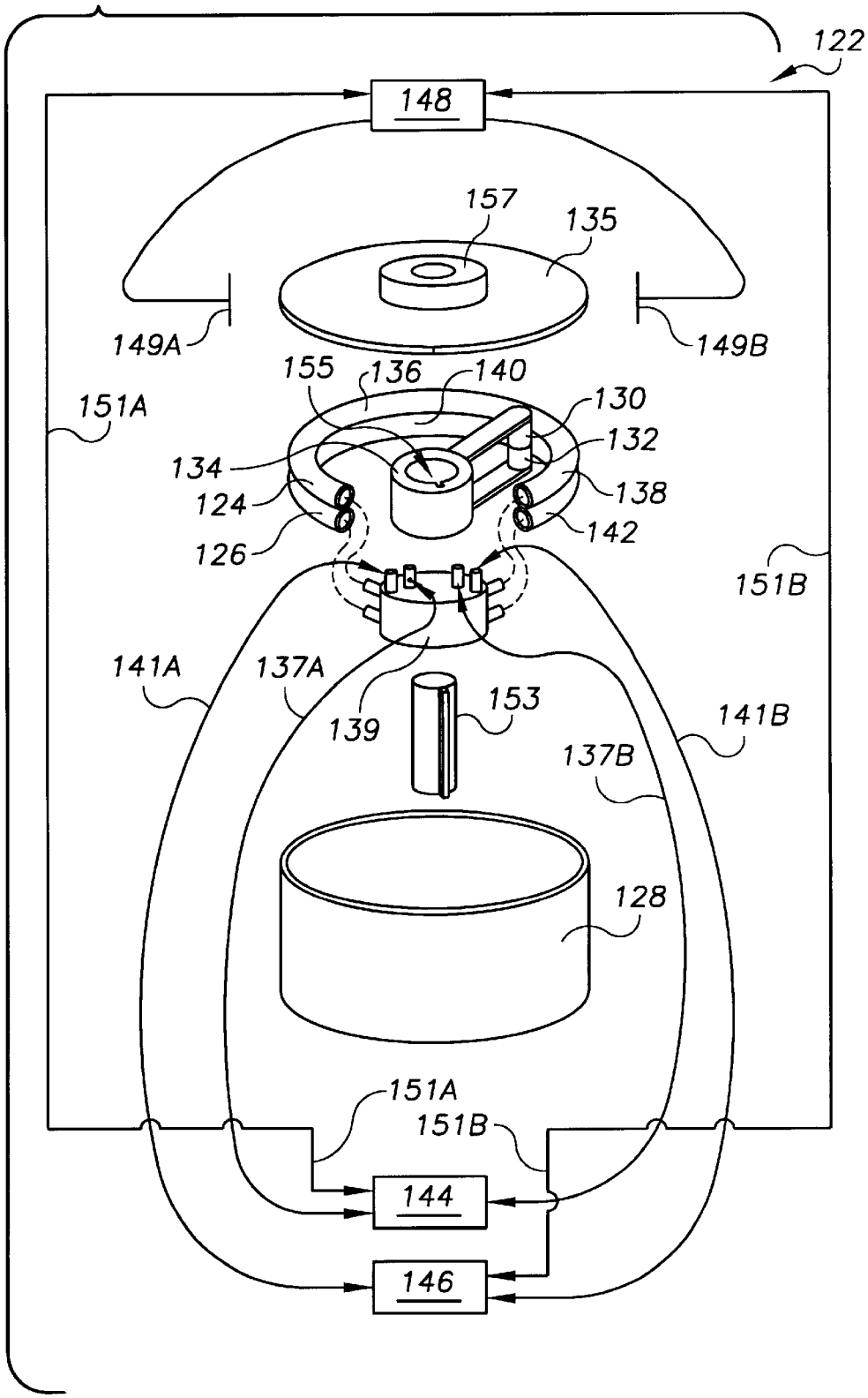
FIG. 5 is an exploded, perspective view of a rotary embodiment of the bi-fluid actuator.

In FIG. 5, a rotary embodiment of the bi-fluid actuator 122 is shown, wherein a pneumatic fluid container 124 is in the form of a first deformable tube, and a hydraulic fluid container 126 is in the form of a second deformable tube secured adjacent to the first deformable tube 124 in parallel circular alignment. Such "deformable tubes" are commonly referred to in the art as "peristaltic tubes". Both the first and second deformable tubes 124, 126 are secured within a cylindrical housing 128. A first mechanical object 130 is in the form of a first pinch roller that pinches or deforms the pneumatic fluid container 124 against the housing 128, and a second mechanical object 132 is in the form of a second pinch roller that is secured to the first pinch roller 130, and that pinches or deforms the hydraulic fluid container 126 against the housing 128.

The first and second mechanical objects 130, 132 or pinch rollers 130, 132 are secured to an armature 134 that is dimensioned to rotate about a center of a circle defined by the first and second deformable tubes 124, 126 and housing 128. The armature 134 may be secured to a keyed shaft 153 which is secured to a rotatable bearing 157 to which a load carriage (not shown) or other mechanical structure that is to be rotated between specific positions at specific rates of travel may be secured. Housing cap 135 may be secured to the cylindrical housing 128. The first pinch roller or first mechanical object 130 deforms the pneumatic fluid container 124 to define a first pneumatic fluid chamber 136 and a second pneumatic fluid chamber 138 on an opposed side of the first pinch roller 130. The second pinch roller or second mechanical object 132 deforms the hydraulic fluid container 126 to define a first hydraulic fluid chamber 140 and a second hydraulic fluid chamber 142 on opposed sides of the second pinch roller 132.

A pneumatic fluid controller 144 is secured in fluid communication between the first and second pneumatic fluid chambers 136, 138 by way of pneumatic lines 137A, 137B that are secured to a junction header 139 that defines separate pneumatic passages to which the first and second pneumatic chambers 136, 138 are secured in fluid communication. A hydraulic fluid controller 146 is secured in fluid communication by way of hydraulic lines 141A, 141B between the controller 146 and the junction header 139 that also defines separate hydraulic passages secured in fluid communication with the first and second hydraulic fluid chambers 140, 142.

A positioning controller 148 may be secured or arranged properly in order to detect a rotational position of the bearing 157 or load carriage secured thereto between movement range limits 149A, 149B. The positioning controller 148 may communicate detected positioning information through a first information transfer mechanism 151A to the pneumatic fluid controller 144, and through a second information transfer mechanism 151B to the hydraulic controller 146. The positioning, pneumatic and hydraulic controllers 148, 144, 146 would work generally as described above to control position and rate of travel of the bearing 157. In the rotary embodiment of the bi-fluid actuator 122, the keyed axle shaft 153 would be dimensioned to mate with a keyed axle throughbore 155 defined within the armature 134 to be secured to the bearing 157 to rotationally secure the armature 134 to the bearing 157.

The action of the second mechanical object or second pinch roller 132 being impacted and moved by movement of the hydraulic fluid between the first and second hydraulic chambers 140, 142 is similar in structure to known peristaltic pumps well known in the art of pumping fluids through deformable tubes where it is important that the fluid remain untouched by mechanical objects such as pump impellers, as is common in human intravenous pumps, etc. However in the present rotary embodiment of the bi-fluid actuator 122, instead of moving the hydraulic fluid, the second mechanical object or second pinch roller 132 is being powered by the force of the compressed pneumatic fluid upon the linked first mechanical object or first pinch roller 130, and a rate of movement, direction of movement, and positioning of the linked first and second mechanical objects is being controlled by movement of the hydraulic fluid between the first and second hydraulic fluid chambers 136, 138, as controlled by the hydraulic fluid controller 146.

Figure 6:
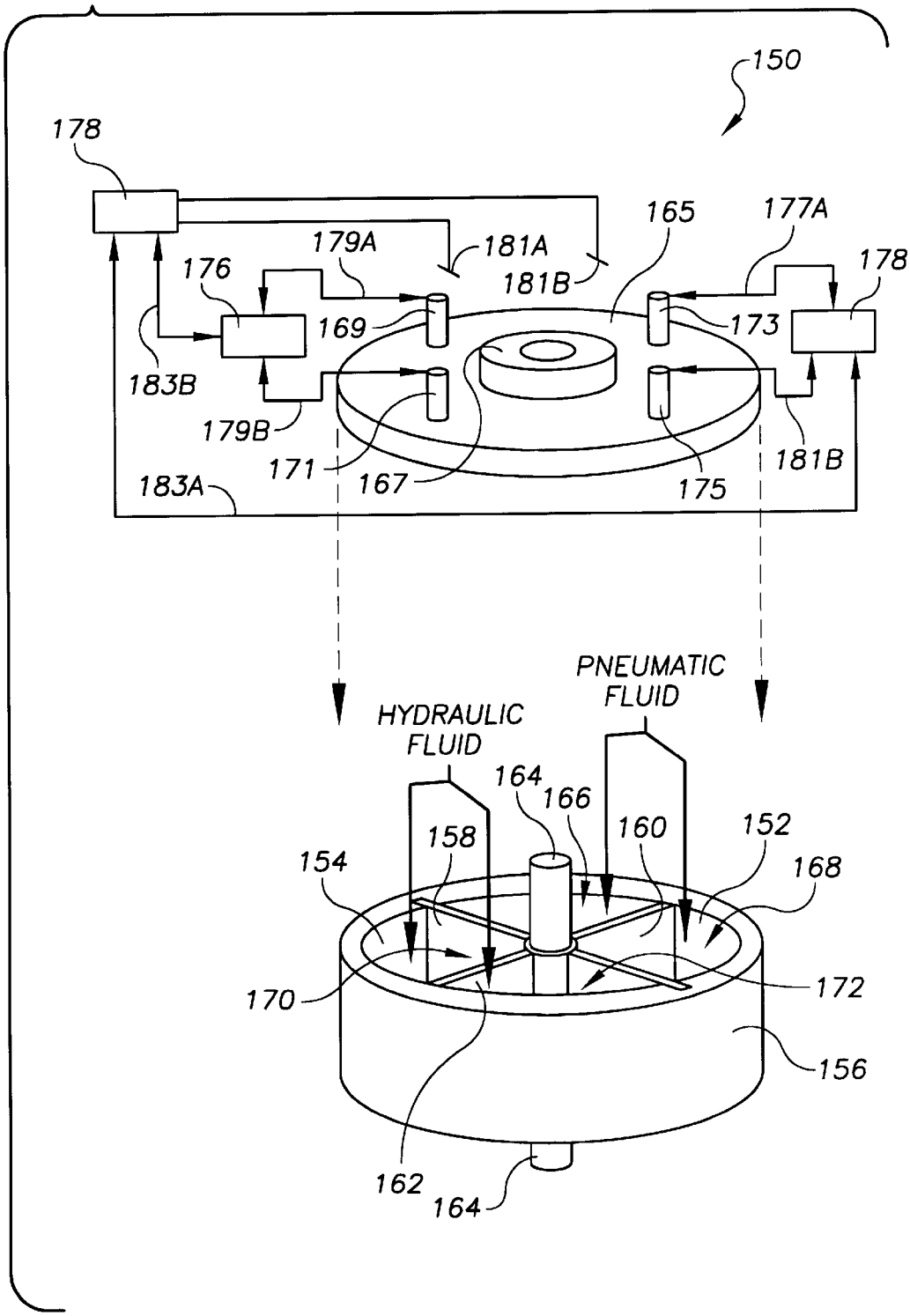
FIG. 6 is an exploded, perspective view of a rotary vane embodiment of the bi-fluid actuator.

In FIG. 6, a rotary vane embodiment of the bi-fluid actuator 150 is shown, wherein a pneumatic fluid container 152 is in the form of a half-cylinder, and a hydraulic fluid container 154 is in the form of an opposed half cylinder defined within a common cylindrical housing 156. A non-rotating containment wall 158 is secured between and defines non-circular walls of the pneumatic and hydraulic fluid containers 152, 154. A first mechanical object 160 is in the form of a first half vane that bi-sects the pneumatic fluid container 152, and a second mechanical object 162 is in the form of a second half vane that bi-sects the hydraulic fluid container 154, wherein the first and second half vanes or first and second mechanical objects 160, 162 are linked to each other and to an armature 164 at the center of a circle defined by the housing 156 so that movement of the first half vane 160 moves both the second half vane 162 and armature 164. The first half vane or first mechanical object 160 defines a first pneumatic fluid chamber 166 and a second pneumatic fluid chamber 168 on opposed sides of the first half vane 160. The second half vane or second mechanical object 162 defines a first hydraulic fluid chamber 170 and a second hydraulic fluid chamber 172 on opposed sides of the second half vane 162.

A header cap 165 is dimensioned to be secured in a non-rotational manner to the cylindrical housing 156 and to make a fluid seal of the pneumatic and hydraulic containers 152, 154 with the header cap 165. The header cap 165 also includes an armature sleeve 167 dimensioned to permit the central armature 164 to pass through the sleeve 167 while restricting passage of fluid through the sleeve 167 so that a load carriage (not shown) may be secured to the central armature extending beyond the header cap 165 to permit limited rotational movement of the load carriage. The header cap 165 also includes a first hydraulic fluid fitting 169 and a second hydraulic fluid fitting 171 that each define separate hydraulic fluid passages. The first hydraulic fitting 169 is secured on or defined in the header plate 165 so that hydraulic fluid passing through it will be directed into or out of the first hydraulic fluid chamber 170, and the second hydraulic fluid fitting 171 is secured to or defined in the plate 165 so that hydraulic fluid passing through the fitting 171 will pass into or out of the second hydraulic fluid chamber 172.

Similarly, the header plate 165 also includes a first pneumatic fluid fitting 173 and a second pneumatic fluid fitting 175, both of which fittings 173, 175 define separate pneumatic passages. The first pneumatic fitting 173 is defined in the header plate 165 so that pneumatic fluid passing through it will be directed into or out of the first pneumatic fluid chamber 166, and the second pneumatic fluid fitting 175 is defined in the plate 165 so that pneumatic fluid passing through the fitting 175 will pass into or out of the second pneumatic fluid chamber 168.

A pneumatic fluid controller 174 is secured in fluid communication between the first and second pneumatic fluid chambers 166, 168, by way of standard pneumatic lines 177A, 177B secured between the controller 174 and the first and second pneumatic fittings 173, 175 of the header plate 165. A hydraulic fluid controller 176 is secured in fluid communication between the first and second hydraulic fluid chambers 170, 172 by way of standard hydraulic lines 179A, 179B secured between the controller 176 and the first and second hydraulic fittings 169, 171 of the header plate 165. A positioning controller 178 may be secured or arranged properly in order to detect a rotational position of the bearing central armature 164 or any load carriage (not shown) secured to the armature 164 between movement range limits 181A, 181B. The positioning controller 178 may communicate detected positioning information through a first information transfer mechanism 183A to the pneumatic fluid controller 174, and through a second information transfer mechanism 183B to the hydraulic controller 176. The positioning, pneumatic and hydraulic controllers 178, 174, 176 would work generally as described above to control position and rate of travel of the central armature 164 or any load carriage (not shown) secured thereto.

The rotary vane embodiment of the bi-fluid actuator 150 would be especially appropriate for rotational movement of objects having desired ranges of motion that are restricted to less than one hundred and eighty degrees, and wherein a desired rate of rotational motion may be significantly greater than an efficient rate of rotational motion for a load carriage rotated by the rotary embodiment of the bi-fluid actuator 122 described above and illustrated in FIG. 5.

Figure 7:
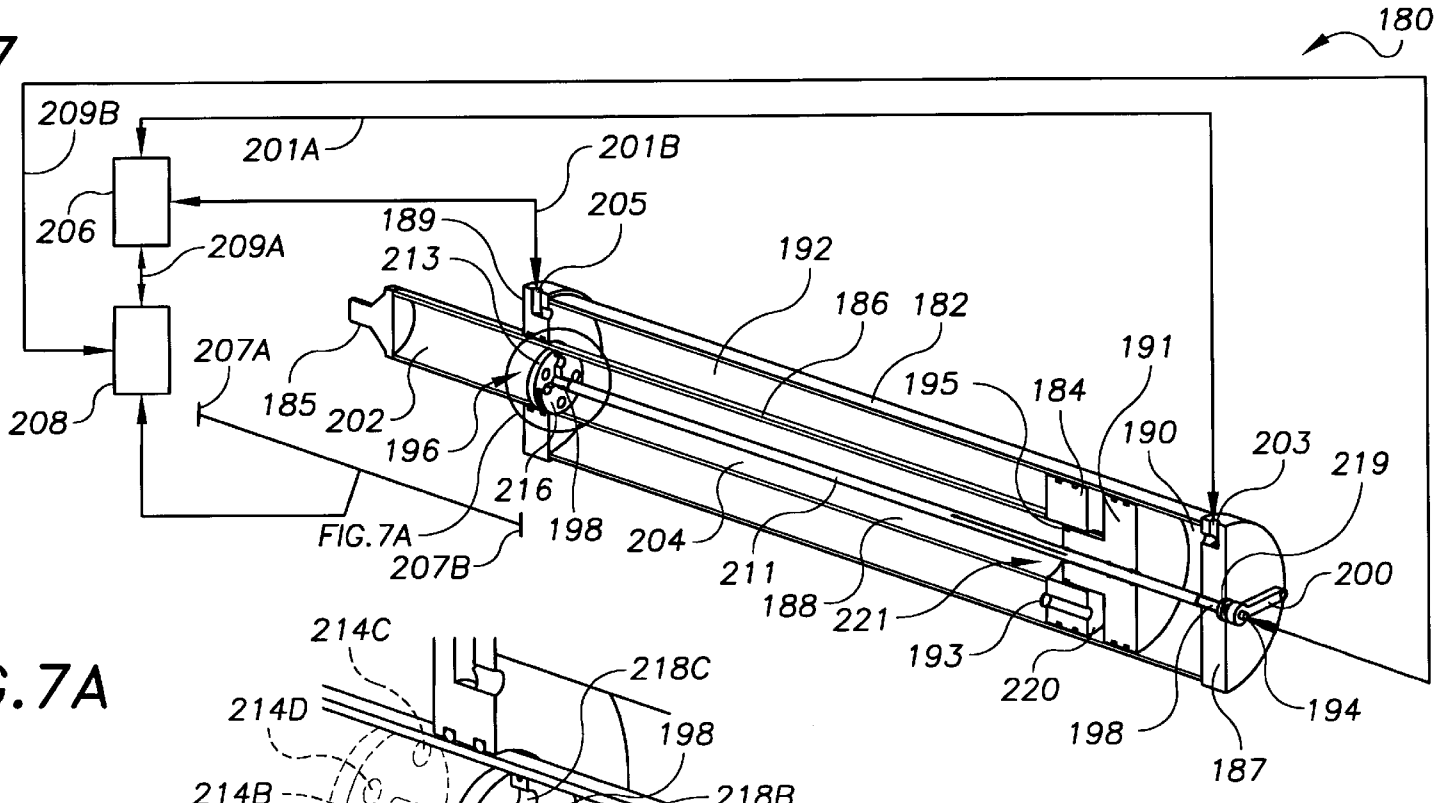
FIG. 7 is a fragmentary, perspective view of a mechanically valved embodiment of the bi-fluid actuator.

In FIG. 7, a mechanically valved embodiment of the bi-fluid actuator 180 is shown, wherein a pneumatic fluid container 182 is in the form of an elongate, hollow container. A first mechanical object is in the form of a piston 184 including a secured hollow rod 186, wherein the rod passes out of the pneumatic fluid container 182 to be secured by a threaded rod adaptor 185 to a load carriage (not shown). A hydraulic fluid container 188 is in the form of a void defined within the hollow rod 186 of the first mechanical object or piston 184. The piston 184 or the first mechanical object defines a first pneumatic fluid chamber 190 and a second pneumatic fluid chamber 192 on opposed sides of the piston 184. A T-piston 191 including a seal 195 is secured adjacent to the first mechanical object or piston 194 and between the first and second pneumatic chambers 190, 192.

A mechanical valve hydraulic fluid controller 194 includes a second mechanical object or rotational port valve assembly 196 secured within the hydraulic fluid container 188. The rotational port valve 196 includes a rotational port plate 213 that is secured to a valve stem 198 that is coaxial with the hollow rod 186 secured to the first mechanical object 184, and that is secured to a mechanical valve trigger 200 positioned outside of the pneumatic fluid container 182 adjacent to a first end seal 187 of the pneumatic fluid container 182. A second end seal 189 is secured to an opposed end of the pneumatic fluid container 182, and the rod 186 passes through the second end seal 189.

Figure 7A:
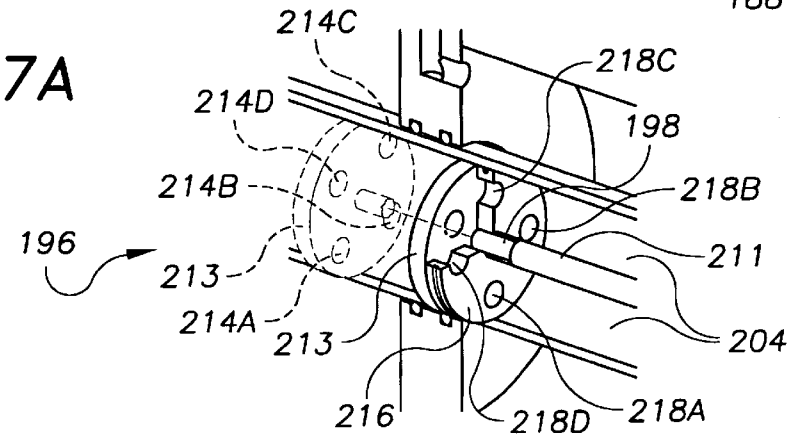
FIG. 7A is a blow-up of a segment of FIG. 7

The valve stem 198 is supported within a stem sleeve 211 that surrounds the valve stem 198, and the valve stem 198 and stem sleeve 211 terminate with the rotational port valve assembly 196. As best seen in the blow-up insert of the rotational port valve assembly 196 in FIG. 7A, the valve stem 198 includes a rotational valve port plate 213 that defines one or more rotational hydraulic fluid ports 214A, 214B, 214C and 214D. The rotational valve port plate 213 is dimensioned to fit snugly within the hydraulic fluid container 188 so that hydraulic fluid may only pass through the rotational hydraulic fluid ports 214A, 214B, 214C and 214D of the rotational valve port plate 213 and not otherwise around the plate 213. The stem sleeve 211 includes a stationary port plate 216 that defines one or more stationary hydraulic fluid ports 218A, 218B, 218C, 218D. The stationary valve port plate 216 is dimensioned to fit snugly within the hydraulic fluid container 188 so that hydraulic fluid may only pass through the hydraulic fluid ports 218A, 218B, 218C, 218D of the stationary port plate 216 and not otherwise around the plate 216. The rotational port plate 213 is secured adjacent to the stationary port plate 216 so that no fluid can flow through the plates 213, 216 unless the rotational hydraulic fluid ports 214A, 214B, 214C, 214D are aligned with the stationary hydraulic fluid ports 218A, 218B, 218C, 218D. The rotational port plate 213 is secured closely to the stationary port plate 216 by a raised boss 219 on the valve stem 198 adjacent to the first end seal 187, so that the valve stem 198 may still be rotated to rotate the rotational port plate 213 while maintaining a seal between the rotational port plate 213 and stationary plate 216.

By rotating the valve trigger 200 that is secured to the valve stem 198 within the fixed position stem sleeve 211, the valve stem 198 is rotated so that the rotational valve port plate 213 and its rotational hydraulic fluid ports 214A, 214B, 214C, 214D may be rotated to overlie one of the stationary hydraulic fluid ports 218A, 218B, 218C, 218D of the stationary plate 216, thereby permitting or terminating movement of the hydraulic fluid through the plates 213, 216 as the entire hydraulic fluid chamber 188 moves along with the first mechanical object 184 and adjacent T-piston 191 that includes the hydraulic fluid chamber 188. Rotating the valve 200 trigger so that the rotational hydraulic fluid ports 214A, 214B, 214C of the rotational valve port plate 213 are not overlying the stationary hydraulic fluid ports 218A, 218B, 218C, 218D of the stationary valve port plate 216 immediately stops movement of the hydraulic fluid chamber 188, and hollow rod 186 secured to the first mechanical object 184 or piston, adjacent to the T-piston 191, as well as any load carriage or load (not shown) secured to the adaptor 185 of the rod.

A first hydraulic fluid chamber 202 and a second hydraulic fluid chamber 204 are defined within the hydraulic fluid container 188 on opposed sides of the rotational valve port plate 213 and stationary valve port plate 216 of the rotational port valve or second mechanical object 196.

A pneumatic fluid controller 206 is secured in fluid communication by standard pneumatic lines 201A, 201B between the first and second pneumatic fluid chambers 190, 192. Pneumatic line 201A is secured between the pneumatic fluid controller 206 and a first port 203 defined in the pneumatic fluid container 182 adjacent the first pneumatic chamber 190 and the first end seal 187. Pneumatic line 201B is secured between the pneumatic fluid controller 206 and a second port 205 defined in the pneumatic fluid container 182 adjacent the second pneumatic fluid chamber 192 and the second end seal 189, as shown in FIG. 7. A positioning controller 208 may be secured or arranged properly in order to detect a position of the rod 186 of any load carriage (not shown) secured to the rod adaptor 185 between movement range limits 207A, 207B. The positioning controller 208 may communicate detected positioning information through a first information transfer mechanism 209A to the pneumatic fluid controller 206, and through a second information transfer mechanism 209B to the mechanical valve trigger 200.

The mechanical valve trigger 200 may be manually actuated by an operator (not shown) to move open or close the rotational port valve assembly 196, to permit movement of the hollow rod 186, and to control a rate of movement of the hollow rod 186. The manual operation may be based upon sensed information from the positioning controller 208, or in the event the positioning controller 208 is not being used, the operator may simply utilize the valve trigger 200 based upon visual observation or other information gathered directly by the operator. Alternatively, the valve trigger 200 may be electro-mechanically operated by apparatus known in the art in response to positioning and program information received from the positioning controller 208. The positioning controller 208, pneumatic controller 206 and an electro-mechanically operated trigger valve 200 would work generally as described above to control position and rate of travel of the hollow rod 186 or any load carriage (not shown) secured to the rod adaptor 185.

In operation of the mechanically valved bi-fluid actuator 180, rotation of the valve trigger 200 of the mechanical valve hydraulic fluid controller 194 permits movement of hydraulic fluid between the first and second hydraulic fluid chambers 202, 204. Therefore, whenever the first or second pneumatic fluid chambers 190, 192 of the pneumatic fluid container 182 contain a compressed fluid and the valve trigger 200 is rotated, the movement of the non-compressible, hydraulic fluid between the first and second hydraulic fluid containers 202, 204 will permit movement of the piston 184 or first mechanical object, adjacent T-piston 191, and the hollow rod 186 until the valve trigger 200 is rotated to stop movement of the hydraulic fluid between the first and second hydraulic fluid chambers 202, 204. The mechanical valve trigger 200 may be any known trigger means for operating a valve including manual, mechanical, electro-mechanical, pneumatic, apparatus, etc. Additionally, in the illustrated embodiment, the mechanical valve trigger 220 is placed outside of the pneumatic fluid container 182. However, the trigger 220 may be integrated within the container 182 for electro-mechanical actuation, etc.

It is noted that a pneumatic void 220 is defined between the piston 184 or first mechanical object and the T-piston 191. The action of the T-piston 191 and pneumatic void 220 aid in compensating for volume changes that occur as the hydraulic fluid flows from the second non-compressible or hydraulic fluid chamber 202 into the first hydraulic fluid chamber 204 as the hollow rod 186 moves away from the first end seal 187. The void 220 within the piston 184 is dimensioned to allow movement of the T-piston along the hollow rod 186 in order to compensate for a volume change of the second hydraulic fluid chamber 204 occupied by the stem sleeve 211 and valve stem 198 of the mechanical valve hydraulic fluid controller 194. Because the second hydraulic chamber 204 within the hollow rod 186 includes the stem sleeve 211, the volume change within the second hydraulic chamber 204 will be different than a volume change within the first hydraulic fluid chamber 202 hollow rod 186 which does not include the stem sleeve 211. As the hydraulic fluid moves into the first hydraulic chamber 202 from the second hydraulic chamber 204, the T-piston 191 is drawn into a compensating throughbore 221 defined within the first mechanical object or piston 184. As the T-piston 191 fills the compensating throughbore 221, the pneumatic void 220 and the second hydraulic fluid chamber 204 decrease in volume. The T-piston 191 may be replaced by its stem portion as a sliding seal within the compensating throughbore 221 in alternative embodiments.

The T-piston 191 or sliding seal is secured with respect to the first mechanical object or piston 184 by a partial vacuum generated by movement of the hydraulic fluid and the seal 195 between the T-piston and the compensating throughbore 221 of the piston 184. The partial vacuum will cause the T-piston 191 to move closer to the piston 184 and into the compensating throughbore 221 or further away from the piston 184, thus causing the pneumatic void 220 to increase or decrease in volume. To prevent any excess build up of air in the pneumatic void 220, a reed valve 193 is secured within the piston 184 in fluid communication between the pneumatic void 220 and the second pneumatic chamber 192 to permit any air build up between the piston 184 and the T-piston 191 to be released from the pneumatic void 220 into the second pneumatic fluid chamber 192.

Extended movement of the hollow rod 186 so that the rod adaptor 185 is at its farthest extension away from the second end seal 189 will create a need for more non-compressible fluid in the first hydraulic fluid chamber 202 and less non-compressible fluid in the second hydraulic fluid chamber 204. Because of the vacuum formed by the seal 195 within the compensating throughbore 121 of the piston 184, the T-piston will be drawn into the compensating throughbore 121, thereby decreasing the volume of the pneumatic void 220. As the rod adaptor 185 is moved back toward the second end 189, the volume of non-compressible fluid occupying the first hydraulic fluid chamber 202 will move into the second hydraulic fluid chamber 204. Because the second hydraulic fluid chamber 204 includes the stem sleeve 211, a compensating volume expansion of that chamber 204 will be required, which is provided for by movement of the T-piston out of the compensating throughbore 121 within the first mechanical object or piston 184. Movement of the T-piston 191 out of and away from the piston 184 increases the volume of the pneumatic void 220, and air is admitted into the pneumatic void 220 through the reed valve 193. Change in the volume of the pneumatic void 220 will not effect the accuracy, movement rate or positioning of the adaptor 185 as the mechanically valved embodiment 180 of the bi-fluid actuator is being utilized.

It can be seen that the above described dual rod embodiment of FIG. 1, single rod embodiment of FIG. 2, rodless piston embodiment of FIG. 3, rodless valved piston embodiment of FIG. 4, rotary embodiment of FIG. 5, rotary vane embodiment of FIG. 6, and the mechanically valved embodiment of FIG. 7 all show bi-fluid actuators that rely upon a common principle of using a pneumatic, compressible fluid to power movement of a mechanical object or load carriage while simultaneously integrating within the same apparatus use of a non-compressible, hydraulic fluid to precisely control that pneumatically powered movement of the mechanical object. Because the hydraulic fluid is used primarily to control position and rate of movement of the mechanical object rather than powering such movement, the hydraulic fluid does not have to be pumped or controlled with large compressors and high pressure hoses, etc. Additionally, because the primary force is supplied by a compressed pneumatic fluid, such as freely available air, the bi-fluid actuator does not present cost, service and hazardous materials risks of known hydraulic and electronic actuators.

While the bi-fluid actuator has been disclosed with respect to the above described and illustrated embodiments, it is to be understood that the invention is not to be limited to those described and illustrated embodiments. For example, it is within the scope of the invention that the pneumatic, hydraulic and positioning controllers of any particular embodiment may themselves be controlled by or be integrated with a computerized overall controller means known in the art. Also, the single rod embodiment of FIG. 2, the rodless piston embodiment of FIG. 3, and the rodless, valved piston embodiment of FIG. 4, are all described above as having pneumatic fluid containers that surround, or partially surround their respective hydraulic fluid containers. However, it is within the scope of the present invention that those embodiments may simply have pneumatic fluid containers that are coaxial with hydraulic fluid containers, so that the pneumatic fluid containers are at least partially surrounded by respective hydraulic fluid containers. Moreover, specific components of the described embodiments of FIGS. 1–7 may be utilized with other described embodiments. For example, the two-way, spring pre-set valve hydraulic fluid controller 118 of the FIG. 4 rodless valved piston, may be utilized as the hydraulic fluid controller of the other embodiments. A two-way, spring pre-set valve means may be secured in fluid communication with the second mechanical objects that are secured between the first and second hydraulic fluid chambers of the FIGS. 1–7 embodiments. Alternatively, a two-way spring pre-set valve means may actually be secured within the second mechanical objects of the embodiments shown in FIGS. 1–3, 6, and 7, as with the FIG. 4 rodless valved piston embodiment.

Additionally, the phrases "pneumatic fluid" and "hydraulic fluid" are not to be limited to simply "air" and known hydraulic fluids, such as hydrocarbon based oils. Rather, the phrase "pneumatic fluid" is meant to include any compressible fluid, and the phrase "hydraulic fluid" is meant to include any non-compressible fluid, including, for example, water, known antifreeze solutions, etc. Further, while the above description characterizes the "pneumatic fluid controller" as directing pressurized or compressed pneumatic fluid into either first or second pneumatic chambers to power movement of the first mechanical object between the chambers, it is to be understood that the phrase "pneumatic fluid controller that selectively directs the pneumatic fluid" may also include application of a partial vacuum to either pneumatic chambers to thereby generate a pressure differential to power the first mechanical object, such as in circumstances of moving small mass loads. Accordingly, reference should be made primarily to the attached claims rather than to the foregoing description to determine the scope of the invention.

What is claimed is:

1. A single rod bi-fluid actuator for precise bi-directional movement and positioning of a load, comprising:

a. a pneumatic fluid container defining a first pneumatic fluid chamber and an opposed second pneumatic fluid chamber, the pneumatic fluid chambers containing a compressible, pneumatic fluid;

b. a hydraulic fluid container defining a first hydraulic fluid chamber and an opposed second hydraulic fluid chamber, the hydraulic fluid chambers containing a non-compressible, hydraulic fluid;

c. a first mechanical object positioned between the first and opposed second pneumatic fluid chambers so that the first mechanical object may be impacted and moved by the pneumatic fluid within the first or second pneumatic chambers;

d. a second mechanical object linked to the first mechanical object and positioned between the first and opposed second hydraulic fluid chambers so that the second mechanical object may be impacted and positioned by the hydraulic fluid;

e. a pneumatic fluid controller that selectively directs the pneumatic fluid into either the first or second pneumatic chamber of the pneumatic fluid container to expand the volume of the pneumatic fluid chamber that receives the pneumatic fluid; and, f. a hydraulic fluid controller that selectively permits, controls a rate of, or terminates passage of the hydraulic fluid between the first and the opposed second hydraulic fluid chambers of the hydraulic fluid container, so that the pneumatic fluid controller selectively powers the first and linked second mechanical objects to move in either a first or opposed second direction, and the hydraulic fluid controller selectively permits movement and controls a rate of movement and position of the second and linked first mechanical objects in the first or opposed second direction by selectively permitting, controlling a rate of, or terminating passage of the hydraulic fluid between the first and second hydraulic fluid chambers of the hydraulic fluid container and;

g. single rod bi-fluid actuator having the pneumatic fluid container secured in coaxial relationship with the hydraulic fluid container, having the first mechanical object coaxial with the hydraulic fluid container, having a rod secured to the first mechanical object and extending out of the pneumatic fluid container to be secured to the load, and having a hydraulic fluid reservoir tube secured adjacent to the hydraulic fluid container and in fluid communication through a hydraulic fluid reservoir opening with the hydraulic fluid container and the hydraulic fluid controller so that the first mechanical object is coaxial with the hydraulic fluid container and hydraulic fluid reservoir tube.

2. The bi-fluid actuator of claim 1, wherein the hydraulic controller is a two-way, spring pre-set valve means for permitting and terminating two-way flow of a non-compressible fluid through the valve in response to pressure changes acting upon the valve and the valve means is secured within the second mechanical object.

3. A rodless piston bi-fluid actuator for precise bi-directional movement and positioning of a load, comprising:

a. a pneumatic fluid container defining a first pneumatic fluid chamber and an opposed second pneumatic fluid chamber, the pneumatic fluid chambers containing a compressible, pneumatic fluid;

b. a hydraulic fluid container defining a first hydraulic fluid chamber and an opposed second hydraulic fluid chamber, the hydraulic fluid chambers containing a non-compressible, hydraulic fluid;

c. a first mechanical object positioned between the first and opposed second pneumatic fluid chambers so that the first mechanical object may be impacted and moved by the pneumatic fluid within the first or second pneumatic chambers;

d. a second mechanical object linked to the first mechanical object and positioned between the first and opposed second hydraulic fluid chambers so that the second mechanical object may be impacted and positioned by the hydraulic fluid;

e. a pneumatic fluid controller that selectively directs the pneumatic fluid into either the first or second pneumatic chamber of the pneumatic fluid container to expand the volume of the pneumatic fluid chamber that receives the pneumatic fluid; and, f. a hydraulic fluid controller that selectively permits, controls a rate of, or terminates passage of the hydraulic fluid between the first and the opposed second hydraulic fluid chambers of the hydraulic fluid container, so that the pneumatic fluid controller selectively powers the first and linked second mechanical objects to move in either a first or opposed second direction, and the hydraulic fluid controller selectively permits movement and controls a rate of movement and position of the second and linked first mechanical objects in the first or opposed second direction by selectively permitting, controlling a rate of, or terminating passage of the hydraulic fluid between the first and second hydraulic fluid chambers of the hydraulic fluid container and;

g. rodless piston bi-fluid actuator, having the pneumatic fluid container in coaxial relationship with the hydraulic fluid container, having the first mechanical object coaxial with the hydraulic fluid container, and having a load carriage linked to the first mechanical object and secured adjacent to the pneumatic fluid container so that movement of the first and second mechanical objects moves the load carriage.

4. The bi-fluid actuator of claim 3 wherein the hydraulic controller is a two-way, spring pre-set valve means secured within the second mechanical object for permitting and terminating two-way flow of a non-compressible fluid through the valve in response to pressure changes acting upon the valve, so that hydraulic fluid may flow through the valve and second mechanical object to permit movement of the second mechanical object and linked first mechanical object whenever pneumatic fluid that is pressurized to a valve override pressure is directed by the pneumatic controller to one of the pneumatic fluid chambers.

5. A rotary bi-fluid actuator for precise bi-directional movement and positioning of a load, comprising:

a. a pneumatic fluid container defining a first pneumatic fluid chamber and an opposed second pneumatic fluid chamber, the pneumatic fluid chambers containing a compressible, pneumatic fluid;

b. a hydraulic fluid container defining a first hydraulic fluid chamber and an opposed second hydraulic fluid chamber, the hydraulic fluid chambers containing a non-compressible, hydraulic fluid;

c. a first mechanical object positioned between the first and opposed second pneumatic fluid chambers so that the first mechanical object may be impacted and moved by the pneumatic fluid within the first or second pneumatic chambers;

d. a second mechanical object linked to the first mechanical object and positioned between the first and opposed second hydraulic fluid chambers so that the second mechanical object may be impacted and positioned by the hydraulic fluid;

e. a pneumatic fluid controller that selectively directs the pneumatic fluid into either the first or second pneumatic chamber of the pneumatic fluid container to expand the volume of the pneumatic fluid chamber that receives the pneumatic fluid; and, f. a hydraulic fluid controller that selectively permits, controls a rate of, or terminates passage of the hydraulic fluid between the first and the opposed second hydraulic fluid chambers of the hydraulic fluid container, so that the pneumatic fluid controller selectively powers the first and linked second mechanical objects to move in either a first or opposed second direction, and the hydraulic fluid controller selectively permits movement and controls a rate of movement and position of the second and linked first mechanical objects in the first or opposed second direction by selectively permitting, controlling a rate of, or terminating passage of the hydraulic fluid between the first and second hydraulic fluid chambers of the hydraulic fluid container and;

g. wherein the pneumatic fluid container is a first deformable tube, the hydraulic fluid container is a second deformable tube secured adjacent to the first deformable tube, the first and second deformable tubes being secured within an at least partially cylindrical housing so that the first and second deformable tubes define at least a portion of a circle, the first mechanical object is a first pinch roller secured to an armature, the second mechanical object is a second pinch roller secured to the armature, the first pinch roller being secured by the armature against the first deformable tube to deform the tube into defining the first and second pneumatic chambers on opposed sides of the first pinch roller, the second pinch roller being linked to the first pinch roller and being secured by the armature against the second deformable tube to deform the tube into defining the first and second hydraulic chambers on opposed sides of the second pinch roller, so that pneumatic fluid within one of the pneumatic fluid chambers will power the first pinch roller, and movement of hydraulic fluid through the hydraulic fluid controller between the hydraulic fluid chambers will permit rotation of the second and linked first pinch rollers and armature.

6. A rotary vane bi-fluid actuator for precise bi-directional movement and positioning of a load, comprising:

a. a pneumatic fluid container defining a first pneumatic fluid chamber and an opposed second pneumatic fluid chamber, the pneumatic fluid chambers containing a compressible, pneumatic fluid;

b. a hydraulic fluid container defining a first hydraulic fluid chamber and an opposed second hydraulic fluid chamber, the hydraulic fluid chambers containing a non-compressible, hydraulic fluid;

c. a first mechanical object positioned between the first and opposed second pneumatic fluid chambers so that the first mechanical object may be impacted and moved by the pneumatic fluid within the first or second pneumatic chambers;

d. a second mechanical object linked to the first mechanical object and positioned between the first and opposed second hydraulic fluid chambers so that the second mechanical object may be impacted and positioned by the hydraulic fluid;

e. a pneumatic fluid controller that selectively directs the pneumatic fluid into either the first or second pneumatic chamber of the pneumatic fluid container to expand the volume of the pneumatic fluid chamber that receives the pneumatic fluid; and, f. a hydraulic fluid controller that selectively permits, controls a rate of, or terminates passage of the hydraulic fluid between the first and the opposed second hydraulic fluid chambers of the hydraulic fluid container, so that the pneumatic fluid controller selectively powers the first and linked second mechanical objects to move in either a first or opposed second direction, and the hydraulic fluid controller selectively permits movement and controls a rate of movement and position of the second and linked first mechanical objects in the first or opposed second direction by selectively permitting, controlling a rate of, or terminating passage of the hydraulic fluid between the first and second hydraulic fluid chambers of the hydraulic fluid container and;

g. wherein the pneumatic container is a half cylinder, the hydraulic container is an opposed half cylinder defined within a cylindrical housing, the pneumatic and hydraulic containers are separated by a non-rotating containment wall, the first mechanical object is a first half vane within the pneumatic container that divides the pneumatic container into the opposed first and second pneumatic fluid chambers, the second mechanical object is a second half vane within the hydraulic container that divides the hydraulic container into the opposed first and second hydraulic fluid chambers, and the first and second half vanes are linked to each other so that pressurized pneumatic fluid within one of the pneumatic fluid chambers will power the first half vane, and movement of the hydraulic fluid through the hydraulic fluid controller between the first and second hydraulic chambers permits movement of the first half vane and second half vane.

7. A mechanically valved bi-fluid actuator for precise bi-directional movement and positioning of a load, comprising:

a. a pneumatic fluid container defining a first pneumatic fluid chamber and an opposed second pneumatic fluid chamber, the pneumatic fluid chambers containing a compressible, pneumatic fluid;

b. a first mechanical object positioned between the first and opposed second pneumatic fluid chambers so that the first mechanical object may be impacted and moved by the pneumatic fluid within the pneumatic fluid chambers, the first mechanical object including a piston and hollow rod secured to the piston that passes out of the pneumatic fluid container for securing the hollow rod to the load, and the first mechanical object including a sliding seal adjustably secured adjacent to the piston so the sliding seal may move into and out of a compensating throughbore of the piston as the piston and sliding seal move within the pneumatic container;

c. a hydraulic fluid container defined within the hollow rod of the first mechanical object and defining a first hydraulic fluid chamber and an opposed second hydraulic chamber, the chambers containing a non-compressible, hydraulic fluid;

d. a mechanical valve hydraulic fluid controller including a second mechanical object rotational port valve assembly secured by a valve stem within the hydraulic container between the first and second hydraulic chambers, the valve stem also including a valve trigger secured to the valve stem, so that movement of the valve trigger rotates a rotational valve port plate to permit or terminate passage of the hydraulic fluid through the rotational port valve assembly between the first and second hydraulic fluid chambers; and, e. a pneumatic fluid controller that selectively directs the pneumatic fluid into either the first or second pneumatic chamber of the pneumatic fluid container to expand the volume of the pneumatic fluid chamber that receives the pneumatic fluid, so that the pneumatic fluid controller selectively powers the first mechanical object to move in either a first or opposed second direction, and the mechanical valve hydraulic fluid controller selectively permits movement and controls a rate of movement and position of the first mechanical object by selectively permitting, controlling a rate of, and terminating passage of the hydraulic fluid between the first and second hydraulic fluid chambers of the hydraulic fluid container.

8. The mechanically valved bi-fluid actuator of claim 7, further comprising a positioning controller means for detecting a position of the load secured to the rod of the first mechanical object.

9. A method of moving, controlling a rate of movement, and positioning a load, comprising the steps of:

a. directing a pneumatic fluid into either a first or second pneumatic fluid chamber of a dual rod bi-fluid actuator, the first or second pneumatic fluid chambers being defined within a pneumatic fluid container of the dual rod bi-fluid actuator, which first and second pneumatic chambers are disposed on opposed sides of a first mechanical object;

b. controlling passage of a hydraulic fluid between a first hydraulic fluid chamber and a second hydraulic fluid chamber defined within a hydraulic fluid container of the dual rod bi-fluid actuator to permit or terminate passage of the fluid between the first and second hydraulic fluid chambers in order to control movement and positioning of a second mechanical object, which second mechanical object is secured between the first and second hydraulic fluid chambers and is also linked to the first mechanical object, and which first mechanical object is secured to the load; and, c. detecting a position of the load with a positioning controller as the load is moved and communicating the detected position to a hydraulic fluid controller that controls the passage of the hydraulic fluid between the first and second hydraulic fluid chambers.

10. A method of moving, controlling a rate of movement, and positioning a load, comprising the steps of:

a. directing a pneumatic fluid into either a first or second pneumatic fluid chamber of a single rod bi-fluid actuator, the first or second pneumatic fluid chambers being defined within a pneumatic fluid container of the single rod bi-fluid actuator, which first and second pneumatic chambers are disposed on opposed sides of a first mechanical object;

b. controlling passage of a hydraulic fluid between a first hydraulic fluid chamber and a second hydraulic fluid chamber defined within a hydraulic fluid container and through a hydraulic fluid reservoir tube secured adjacent and parallel to the hydraulic fluid container of the single rod bi-fluid actuator to permit or terminate passage of the fluid between the first and second hydraulic fluid chambers in order to control movement and positioning of a second mechanical object, which second mechanical object is secured between the first and second hydraulic fluid chambers and is also linked to the first mechanical object and which first mechanical object is secured to the load; and, c. detecting a position of the load with a positioning controller as the load is moved and communicating the detected position to a hydraulic fluid controller that controls the passage of the hydraulic fluid between the first and second hydraulic fluid chambers.

11. A method of moving, controlling a rate of movement, and positioning a load, comprising the steps of:

a. directing a pneumatic fluid into either a first or second pneumatic fluid chamber of a rodless piston bi-fluid actuator, the first or second pneumatic fluid chambers being defined within a pneumatic fluid container of the rodless piston bi-fluid actuator, which first and second pneumatic chambers are disposed on opposed sides of a first mechanical object;

b. controlling passage of a hydraulic fluid between a first hydraulic fluid chamber and a second hydraulic fluid chamber defined within a hydraulic fluid container of the rodless piston bi-fluid actuator to permit or terminate passage of the fluid between the first and second hydraulic fluid chambers in order to control movement and positioning of a second mechanical object, which second mechanical object is secured between the first and second hydraulic fluid chambers and is also linked to the first mechanical object, and which first mechanical object is secured to the load; and, c. detecting a position of the load with a positioning controller as the load is moved and communicating the detected position to a hydraulic fluid controller that controls the passage of the hydraulic fluid between the first and second hydraulic fluid chambers.

12. The method of claim 11, wherein the step of directing a pneumatic fluid further comprises directing the pneumatic fluid into the first or second pneumatic fluid chamber of a rodless valved piston bi-fluid actuator.

13. A method of moving, controlling a rate of movement, and positioning a load, comprising the steps of:

a. directing a pneumatic fluid into either a first or second pneumatic fluid chamber of a rotary bi-fluid actuator, the first or second pneumatic fluid chambers being defined within a deformable tube pneumatic fluid container of the rotary bi-fluid actuator, which first and second pneumatic chambers are disposed on opposed sides of a pinch roller first mechanical object;

b. controlling passage of a hydraulic fluid between a first hydraulic fluid chamber and a second hydraulic fluid chamber defined within a deformable tube hydraulic fluid container of the rotary bi-fluid actuator to permit or terminate passage of the fluid between the first and second hydraulic fluid chambers in order to control movement and positioning of a second pinch roller mechanical object, which second mechanical object is secured between the first and second hydraulic fluid chambers and is also linked to the first mechanical object, and which first mechanical object is secured to the load; and, c. detecting a position of the load with a positioning controller as the load is moved and communicating the detected position to a hydraulic fluid controller that controls the passage of the hydraulic fluid between the first and second hydraulic fluid chambers.

* * * * *